US007083010B2

(12) United States Patent
Eppink et al.

(10) Patent No.: US 7,083,010 B2
(45) Date of Patent: Aug. 1, 2006

(54) APPARATUS AND METHOD FOR DRILLING AND REAMING A BOREHOLE

(75) Inventors: Jay M. Eppink, Spring, TX (US); Albert C. Odell, II, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/173,102

(22) Filed: Jul. 1, 2005

(65) Prior Publication Data

US 2005/0241858 A1 Nov. 3, 2005

Related U.S. Application Data

(60) Division of application No. 10/304,842, filed on Nov. 26, 2002, now Pat. No. 6,920,944, which is a continuation-in-part of application No. 09/718,722, filed on Nov. 22, 2000, now Pat. No. 6,494,272, which is a division of application No. 09/427,905, filed on Oct. 27, 1999, now Pat. No. 6,227,312, which is a division of application No. 08/984,846, filed on Dec. 4, 1997, now Pat. No. 6,213,226, said application No. 10/304,842 and a continuation-in-part of application No. 09/603,706, filed on Jun. 27, 2000, now Pat. No. 6,488,104, is a continuation of application No. 08/984,846, filed on Dec. 4, 1997, now Pat. No. 6,213,226.

(51) Int. Cl.

| | |
|---|---|
| ***E21B 7/28*** | (2006.01) |
| ***E21B 7/08*** | (2006.01) |
| ***E21B 17/10*** | (2006.01) |

(52) U.S. Cl. ..... 175/325.2; 175/406

(58) Field of Classification Search ..... 175/73, 175/76, 320.1, 406, 320.2, 269, 325.1, 325.2
See application file for complete search history.

(56) References Cited

U.S. PATENT DOCUMENTS

| | | | | |
|---|---|---|---|---|
| 4,491,187 | A * | 1/1985 | Russell | 175/325.2 |
| 5,293,945 | A * | 3/1994 | Rosenhauch et al. | 175/325.2 |
| 5,402,856 | A * | 4/1995 | Warren et al. | 175/57 |
| 5,765,653 | A * | 6/1998 | Doster et al. | 175/75 |
| 5,788,000 | A * | 8/1998 | Maury et al. | 175/325.1 |
| 5,931,239 | A * | 8/1999 | Schuh | 175/61 |
| 6,059,051 | A * | 5/2000 | Jewkes et al. | 175/76 |

* cited by examiner

*Primary Examiner*—Hoang Dang
(74) *Attorney, Agent, or Firm*—Conley Rose, P.C.

(57) ABSTRACT

A drilling assembly, a reamer, and an adjustable diameter stabilizer are disclosed. The reamer includes cutter elements mounted on at least a first fixed blade for reaming a previously-formed borehole or for forming a borehole of increased diameter beneath an existing cased borehole. The apparatus provides for stabilizing the drilling assembly so that the reamer may be used in back reaming the hole. Retainer means, such as shear pins or spring-biased reciprocating latch members, are provided to prevent premature extension of the adjustable diameter stabilizer's moveable members, including blades and pistons. The shear pins are preferably accessible from the outer surface of the reamer housing so as to expedite field replacement of the shear pins without requiring disassembly of the reamer. The spring-biased latching members repeatedly latch and unlatch so that field replacement is not required, and so that the movable members may be extended and contracted multiple times while the reamer is downhole.

29 Claims, 16 Drawing Sheets

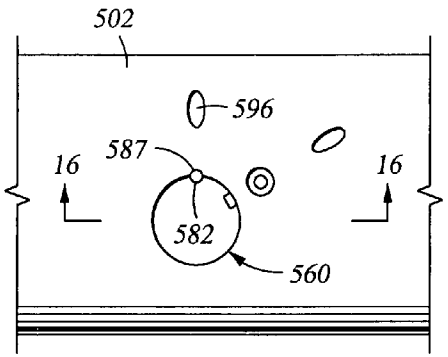
Fig. 15
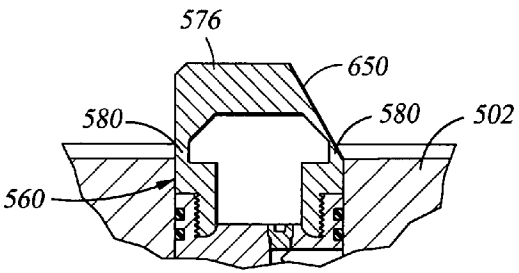
Fig. 16
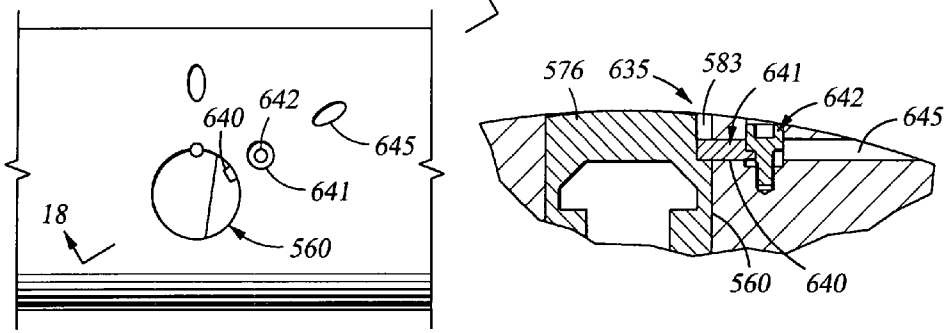
Fig. 17
Fig. 18
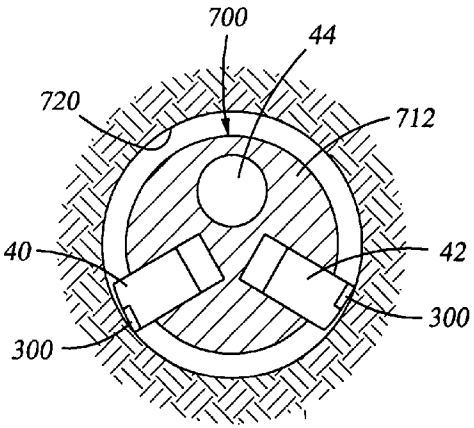
Fig. 19

APPARATUS AND METHOD FOR DRILLING AND REAMING A BOREHOLE

CROSS-REFERENCE TO RELATED APPLICATIONS

This is a divisional application of U.S. Pat. No. 6,920,944 filed Nov. 26, 2002, which is a continuation-in-part application of U.S. Pat. No. 6,494,272, filed Nov. 22, 2000, which is a divisional of U.S. Pat. No. 6,227,312, filed Oct. 27, 1999, which is a divisional of U.S. Pat. No. 6,213,226, filed Dec. 4, 1997, each incorporated herein by reference. U.S. patent application Ser. No. 10/304,842, filed Nov. 26, 2002, is also a continuation-in-part application of U.S. Pat. No. 6,448,104, filed Jun. 27, 2000, which is a continuation of U.S. Pat. No. 6,213,226, filed Dec. 4, 1997, each incorporated herein by reference.

STATEMENT REGARDING FEDERALLY SPONSORED RESEARCH OR DEVELOPMENT

Not Applicable.

BACKGROUND OF THE INVENTION

The present invention relates to systems and apparatus for drilling boreholes in the earth for the ultimate recovery of useful natural resources, such as oil and gas. More particularly, the invention relates to apparatus and methods for reaming a borehole and for stabilizing a drilling assembly. Still more particularly, the invention relates to apparatus and methods that include reaming and back reaming a borehole to have a diameter that is larger than the inside diameter of the casing string or open hole that is above the borehole.

In the drilling of oil and gas wells, it is frequently necessary or desirable to "ream" a borehole that has been previously created by a drill bit or other cutting tool so as to remove formation projections that may have survived the first pass of the drilling assembly and to thereby provide a relatively smooth and more uniform borehole wall surface. In certain applications, a reamer is placed behind the drill bit on the drilling assembly so as to ream the hole immediately after the bit has formed the borehole. It is sometimes preferred that such a reaming step be performed as the bit is being withdrawn from the borehole, such process being referred to as "backreaming." An alternative to backreaming is to withdraw the bit and then run into the hole a drill string having a reamer on the end. This, of course, requires an extra trip of the drill string and thus is costly and undesirable in most cases.

Ensuring a relatively smooth borehole well is particularly important to ease the installation of well casing. In the drilling process, concentric casing strings are installed and cemented in the borehole as drilling progresses to increasing depths. In supporting the additional casing strings within the previously run strings, the annular space around the newly installed casing string is limited. Further, as successively smaller diameter casings are suspended within the well, the flow area within the casing for the production of oil and gas is reduced. To increase the annular area for the cementing operation and to increase the production flow area, it has become common to drill a larger diameter new borehole below the terminal end of the previously installed and cemented casing string. Enlarging the borehole beneath the previously installed casing string permits the installation of new casing that is larger than that which could otherwise have been installed in the smaller borehole. By drilling the new borehole with a diameter that is larger than the inside diameter of the existing cased borehole, a larger annular area is provided for the cementing operation. Further, the subsequently suspended new casing may itself have a larger inner diameter than otherwise possible so as to provide a larger flow area for the production of oil and gas.

Various methods and apparatus have been devised for passing a drilling assembly through the existing cased borehole, yet permitting the assembly to then drill a new borehole that is larger in diameter than the inside diameter of the upper, existing cased borehole. One such method is to use under reamers, which are tools that are collapsed to pass through the smaller diameter of the cased borehole and thereafter expanded to ream the new borehole and provide a larger diameter for the installation of new casing. Many conventional under reamers employ concentric bodies and pivotable arms that, in certain instances, have tended to break during operation. When this occurs, the broken components must be "fished" from the hole before drilling can continue, thus greatly increasing the time and cost required to drill the borehole. Another such method is to employ a winged reamer disposed above a conventional bit. Still another method for drilling a larger diameter borehole is to employ a drilling assembly that includes a bi-center bit.

The bi-center bit is a combination eccentric reamer section and pilot bit. The pilot bit is disposed on the lowermost end of the drilling assembly with the reamer section disposed above the pilot bit. The pilot bit drills a pilot borehole on center in the desired trajectory of the well path, and then the eccentric reamer section follows the pilot bit, reaming the pilot borehole to the desired diameter for the new borehole. The diameter of the pilot bit is made as large as possible to provide stability, but it is not made so large as to prevent the combination of pilot bit and winged reamer from passing through the cased borehole. Certain conventional such bi-center bits drill a borehole that is approximately 15% larger than the diameter of the existing cased borehole. However, since the reamer section is eccentric, the reamer section tends to cause the bit axis angle to slightly shift during its rotation, thus pointing the bit in different directions, and therefore to deviate from the desired trajectory of drilling the well path. Also, the bi-center bit also tends to be pushed away from the center of the borehole because of the resultant force of the radial forces acting on the reamer blade (caused by weight on bit and by the circumferential forces caused by and acting on the cutters on the pilot bit) Also, the direction and magnitude of these radial forces change as drilling parameters such as RPM, weight on bit, hole inclination, and formation type change, which influences directional tendencies of the bit. In certain formations, these lateral forces can cause the pilot bit to drill its portion of hole oversize, and thus the reamer section of the bi-center bit to drill an undersized hole.

It is well understood that to control the direction of drill path, stabilizers are provided on the drill string. By appropriately positioning a stabilizer of a particular design, the trajectory of the drill path can be better controlled. In certain drilling circumstances, it is desirable to place a stabilizer adjacent to the bi-center bit. However, space limitations in the casing, through which all components of the drilling assembly must pass has, in the past, prevented the placement of a "near-bit" stabilizer adjacent to a bi-center bit.

U.S. Pat. No. 6,213,226, (the entire disclosure of which is hereby incorporated by reference into this application), describes an eccentric, adjustable blade stabilizer that may be placed close to a bi-center bit in order to stabilize the bit and to effect the drilling of a larger bore hole in the desired trajectory beneath a section of a previously-cased borehole. The apparatus described therein includes extendable blades that, once below the previously-cased borehole and into the newly formed borehole, expand to the full gage diameter of the new borehole to provide enhanced stability for the bi-center bit and to align the pilot bit with the axis of the existing borehole. Also incorporated by reference into this application is U.S. Pat. No. 6,227,312.

Conventional bi-center bits, however, cannot effectively be used to "back ream" the newly formed borehole because of a lack of adequate stabilization. More specifically, as the drilling assembly having the bi-center bit is withdrawn, the pilot bit does not provide the stabilization needed to cause the winged blade to ream properly. Instead, the forces imposed by the formation material on the wing of the bi-center bit pushes the drilling assembly off center once the pilot bit has been withdrawn from the pilot hole and enters the region of the newly formed borehole having the larger diameter. Thus, the reamer of the bi-center bit is not sufficiently stabilized by the pilot bit to permit effective back reaming. Accordingly, the new section of the borehole has to be drilled correctly and entirely in a single pass, or else a second trip of the drill string would be required to conduct a reaming procedure.

In certain formations, it is also desirable or necessary to drill an enlarged borehole beneath a previously-drilled and uncased (open) borehole. This is because certain formations are sensitive to the increased fluid pressures that result from smaller hole diameters. Such higher pressures or fluctuations in pressures may cause sloughing off of formation material into the borehole. Accordingly, to lessen the likelihood of such an occurrence, it is known to drill a larger diameter borehole at locations beneath open holes having a smaller diameter so as to reduce the equivalent circulating density ("ECD") of the drilling fluid. Thus, it would thus be desirable to develop a drilling assembly that can be employed to drill an enlarged borehole beneath a cased section or beneath a previously drilled open hole where the assembly can also be used to back ream the newly formed and enlarged hole.

A particular use of a bi-centered bit is in drilling out the casing shoe. A casing shoe is placed on the lowermost end of a casing string and is used to guide the casing string into the wellbore since there may be partial obstructions in the wellbore, such as ledges, for example. The typical casing shoe includes a generally cylindrical steel casing having an internally threaded upper box portion for connection to a complementary pin portion of a casing string. The lower end of the shoe includes a central portion made of drillable material (such as cement, aluminum, plastics or the like) and a generally rounded nose projecting frontwards, beyond the forward or lowermost end of the casing.

Upon installing and cementing a casing in a newly drilled borehole, the casing shoe attached to the lower end of the casing also becomes cemented into the borehole. Thus, to drill a new borehole below the cased borehole, it is necessary that the shoe and remaining cement first be drilled out. It was once standard practice to drill through the casing shoe using a standard drill bit, then to remove the bit from the hole, install a bi-center bit on the drill string and run it into the cased borehole, and then to drill the enlarged hole beneath the installed casing. However, that practice required an extra trip of the drill string and thus was time consuming, costly and undesirable. More recently, specialized bits have been developed for drilling through the casing shoe, and then continuing to drill to form an enlarged hole beneath the cased borehole. This allowed the new borehole to be created without requiring an additional trip of the drill string to attach a bi-center bit. One such bit said to be designed for drilling out the casing shoe and continuing on to drill the enlarged borehole beneath the installed casing is disclosed in U.S. Pat. No. 6,340,064.

In general, the specialized bits for drilling through the casing shoe are a form of a bi-center bit, the bit having a first pilot bit and a set of offset cutters axially disposed from the pilot bit and extending radially beyond the diameter of the pilot bit. However, without a near bit stabilizer, the specialized bit for drilling the casing shoe could not provide back reaming as the bit is removed from the borehole due to the formation pushing the drilling assembly off center, as previously discussed.

To drill the casing shoe, the drill string is rotated as drilling fluid is pumped down through the drill string and out the face of the bit, the fluid returning to the surface along the annulus formed between the drill string and the casing wall. For use after the bi-center bit has passed through the casing and begun to cut the enlarged borehole, it would be desirable to include in the drilling assembly a near-bit, eccentric, adjustable blade stabilizer, such as that disclosed in U.S. Pat. No. 6,213,226. The stabilizer disclosed therein, however, includes means for extending the blades upon increasing the pressure of the drilling fluid passing through the drill string. In other words, the blades are retained in a contracted position by spring force until a predetermined drilling fluid pressure causes them to extend.

When drilling out the casing shoe using a bi-center bit, it is important, therefore, that the stabilizer blades not be extended prematurely. However, when drilling through the cement or other material of the casing shoe, high fluid pressure may be required as compared to that used merely to pass the drilling assembly to the bottom of the existing casing. This increase in fluid pressure could cause the extendable stabilizer blades of a stabilizer such as that disclosed in U.S. Pat. No. 6,213,226 to extend prematurely, detrimentally effecting the ability of the bit to drill out the casing shoe. Alternatively, premature blade extension while the shoe is being drilled may damage the stabilizer blades, rendering them ineffective or less effective in guiding the bit along the intended drilling path after the casing shoe has been drilled out. Accordingly, where a near bit, eccentric, adjustable blade stabilizer is employed, it would be desirable to provide a means to ensure that the blades do not extend prematurely, and that they remain in their completely retracted position until a predetermined control is sent from the surface to the drilling assembly.

SUMMARY OF PREFERRED EMBODIMENTS OF THE INVENTION

The embodiments described herein provide a drilling assembly useful in various applications. A first embodiment includes a pilot bit and an eccentric, adjustable diameter reamer above the pilot bit. The assembly may be passed through an existing borehole (cased or opened) and employed to drill at a diameter that is larger than the diameter of the hole above.

Certain embodiments described herein include a fixed blade and at least one extendable member that can be extended to adjust and enlarge the diameter of the reamer. Once the assembly has been passed beneath the existing borehole, with its extendable members in the contracted position, the members can then be extended and the assembly rotated to form a larger diameter borehole. The extendable members may be elongate blades or other structures, such as pads or pistons. It is desirable that a plurality of cutter elements be mounted on one or more of the blades of the reamer so as to ream the borehole formed by the pilot bit to the desired larger diameter, and also to provide a means for back reaming the hole as the drilling assembly is raised or removed from the borehole. The cutter elements may be placed on the fixed blade, the extendable blades, or both. In certain preferred embodiments, the fixed blade is releasably affixed to the reamer housing so that blades having greater or lesser radial extension may be substituted for a given blade. The back reaming capabilities of these embodiments offer substantial savings in time and cost as compared with traditional assemblies that cannot back ream and that, where back reaming is desired, would require an additional trip of the drill string.

Certain embodiments of the invention also include means for retaining the extendable members in their contracted position until it is desirable to expand the diameter of the tool for reaming, such as after the drilling assembly has passed through the smaller, preexisting borehole. The latching retainers may include shear pins that prevent the extendable members from moving until the pressure of the drilling fluid being pumped through the reamer reaches a predetermined fluid pressure. In certain preferred shear pins, the pins include a head portion, a shank portion, and a reduced diameter portion along the shank such that, upon the predetermined fluid pressure being exceeded, the pin will shear at the reduced diameter portion allowing the moveable member to extend. The shear pin preferably is disposed in a bore formed in the outer surface of the reamer housing so that it is accessible without requiring disassembly of the reamer. This arrangement facilitates quick and simple field replacement or substitution the shear pin. The latching retainers may likewise be non-shearing members, such as spring biased latching members having an extension that is biased to engage a recess in the movable member and that disengages upon a predetermined drilling fluid pressure. A latching retainer is also disclosed for releasably and repeatedly locking the movable member in its extended position.

Providing cutter elements on all the blades of the reamer permits the reamer blades to be designed so that the cutting forces may be closer to being balanced, thereby reducing lateral loads on the movable members such as pistons and blades. Further, the drilling assembly and reamer described herein allow the formation of a larger diameter borehole beneath a casing string without requiring the use of a bi-center bit which, because it is not mass balanced, may cause bit wobble and deviation from the desired drilling path. This mass imbalance of a bi-center bit may also assist in causing the pilot bit to drill an oversized hole which will cause the reamer section to drill an undersized hole.

Certain embodiments of the invention include extendable pistons and actuators for extending the pistons when the pressure of the drilling fluid being pumped through the reamer assembly reaches a predetermined pressure. The pistons may include a piston head having an outer surface that, in profile, includes an inclined and generally flattened surface. The inclined surface is retained in an orientation to face uphole so that, upon moving the tool upwards in the borehole, the inclined surface will act as a camming surface with the borehole wall tending to retract the piston in the event that the normal retracting means fails. Furthermore, a piston head described herein may include a central cavity and a thin-walled region such that, should the piston fail to retract, an upward force on the drilling assembly of a predetermined magnitude will cause the piston head to shear at the thin-walled section and allow removal of the tool. The extending pistons may be oriented so as to extend at an angle that is perpendicular to the axis of the tool housing or, for applying greater force on the borehole wall, may extend at an angle that is not perpendicular. For example, the extending pistons may be oriented to extend at an acute angle of less than 90°, such as between 10° and 60°.

Other embodiments of the invention include a damping means to restrict the velocity at which the moveable members may move from the extended position toward the contracted position. This feature is desired because as the reamer is rotated in the borehole, formation projections and the resulting forces from the formation will tend to bias the extending member toward its contracted position. One dampening means for slowing the inward movement of the extendable member includes an orifice that restricts the volume of fluid flow as the extendable member is pushed toward the contracted position.

In another embodiment, an adjustable diameter stabilizer is provided having one or more extendable members but requiring no fixed blade. This embodiment may be employed in a drilling assembly above a conventional reamer so as to oppose the tilting of the drill string and the formation of an undesired borehole as might otherwise occur.

Thus the embodiments described herein comprise a combination of features and advantages believed to substantially advance the drilling art. The features and characteristics mentioned above, and others, will be readily apparent to those skilled in the art upon reading the following detailed description of preferred embodiments, and by referring to the accompany drawings.

BRIEF DESCRIPTION OF THE DRAWINGS

FIG. 15 is a partial elevation view of the reamer as viewed in FIG. 13B with the piston in its extended position.

FIG. 16 is a diagrammatic, partial cross-sectional view, taken along plane 16—16 of FIG. 15.

FIG. 17 is a partial elevation view of the reamer as viewed in FIG. 13A with the extendable piston in its retracted position.

FIG. 18 is a partial cross-sectional view taken along plane 18—18 of FIG. 17.

FIG. 19 is a diagrammatic, cross-sectional view of an alternative embodiment of an eccentric stabilizer/reamer in a borehole with the extendable members depicted in their fully extended position.

DESCRIPTION OF PREFERRED EMBODIMENTS

In the following discussion and in the claims, the terms "including" and "comprising" are used in an open-ended fashion, and thus should be interpreted to mean "including, but not limited to . . . ". Also, reference to "up" or "down" are made for purposes of ease of description with "up" meaning towards the surface of the wellbore, and "down" meaning towards the bottom of the wellbore. In addition, in the discussion and claims that follow, it is sometimes stated that certain components or elements are in "fluid communication." By this it is meant that the components are constructed and interrelated such that a fluid can be communicated between them, as via a passageway, tube or conduit.

Figure 1:
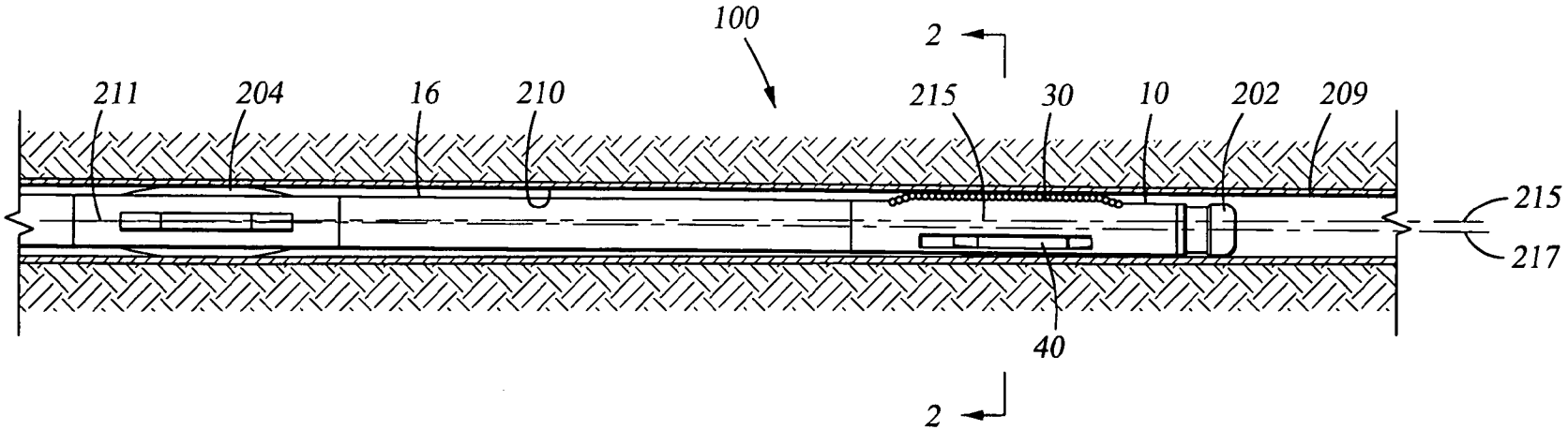
FIG. 1 is a diagrammatic elevation view, partially in cross section, showing a bottom hole assembly with a near bit, eccentric, adjustable diameter reamer with extendable blades disposed in a cased borehole.
Figure 2:
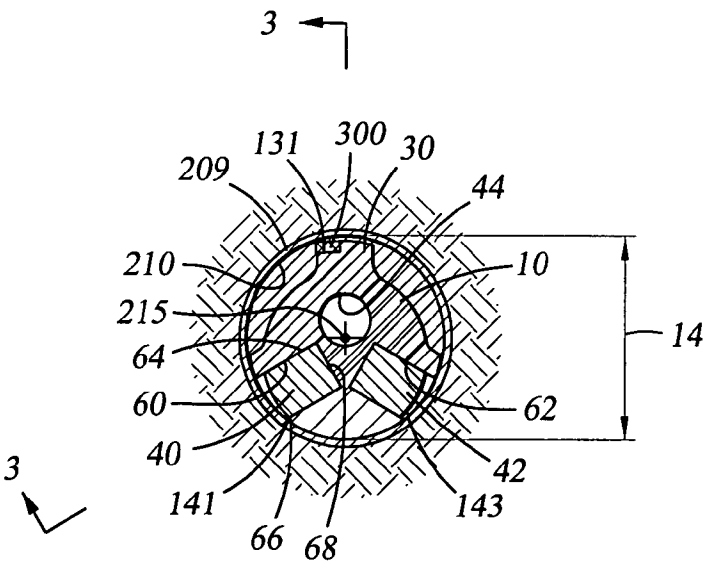
FIG. 2 is a cross-sectional view of the eccentric reamer taken along plane 2—2 of FIG. 1, with the adjustable blades shown in the contracted position.
Figure 3:
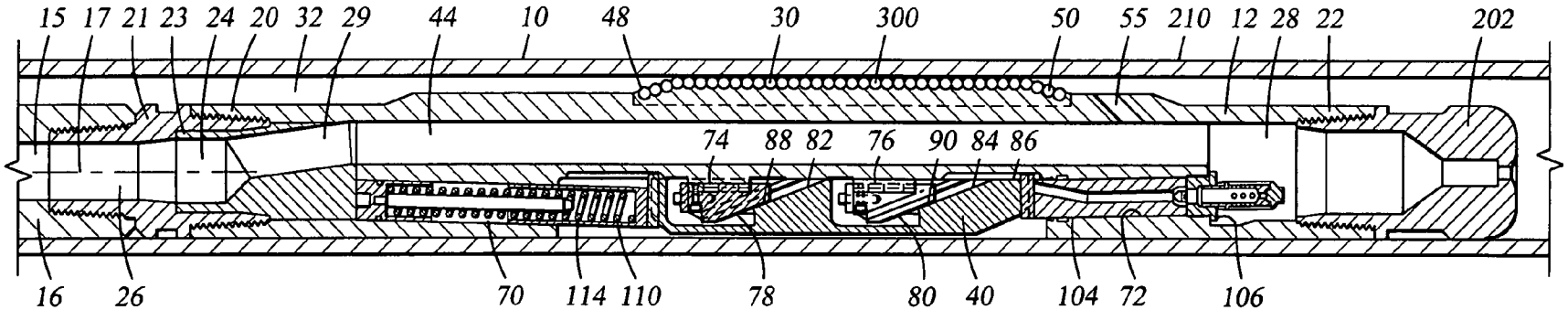
FIG. 3 is an enlarged, longitudinal cross sectional view of the reamer shown in FIGS. 1 and 2.

Referring first to FIGS. 1–3, there is shown a bottom hole assembly 100 disposed in casing 209 of cased borehole 210. Assembly 100 includes drill bit 202, an eccentric, adjustable diameter reamer 10, one or more drill collars 16 and a fixed blade stabilizer 204. Assembly 100 may include additional tubular members, bottom hole assembly tools or subassemblies (not shown) in addition to or in place of drill collars 16. Reamer 10 is located above and close to bit 202 and, in this embodiment, includes a fixed blade 30 and a pair of adjustable blades 40,42 described in more detail below. Fixed blade stabilizer 204 is preferably located well above bit 202 and, for example, may be approximately thirty feet above the bit.

Referring particularly to FIGS. 2 and 3, eccentric reamer 10 includes a generally tubular mandrel or housing 12 having a central axis 17 and a primary thickness or diameter 14 that is only slightly less than the inner diameter of the casing 209, such primary diameter 14 being measured between the radially outermost edge of fixed blade 30 and the portion of the housing 12 that is opposite the blade. Housing 12 includes threaded box ends 20, 22. Upstream box end 20 is connected to a threaded pin end of a tubular adapter sub 21, which in turn has another pin end connected to the box end of drill collar 16. The downstream box end 22 of housing 12 is connected to bit 202. An annulus 32 is formed between bottom hole assembly 100 and casing 209.

In this embodiment of the invention, reamer 10 further includes three contact members which contact the interior wall of casing 209, namely fixed blade 30 and a pair of adjustable or expandable blades 40, 42, each equidistantly spaced apart approximately 120° around the circumference of housing 12, although other angular spacings may be employed. It should be appreciated that the cross-section shown in FIG. 3 passes through blades 30 and 40 by draftsman's license, as shown in FIG. 2, for added clarity. Each of the blades 30, 40, 42 includes an upstream chamfered or inclined surface 48 and a downstream chamfered or inclined surface 50 to facilitate passage of the reamer 10 through the casing 209. Surfaces 48, 50 may alternatively be parabolic shaped. Further, upon withdrawing of the assembly 100 from the borehole, inclined surfaces 48 act as camming surfaces to assist in retracting blades 40, 42 into the housing 12.

Reviewing still FIGS. 2 and 3, a flowbore 26 is formed through bottom hole assembly 100 and is in fluid communication with the central flow bore 15 in drill collars 16. Flow bore 26 includes the upstream body cavity 24 of housing 12, downstream body cavity 28 of housing 12 and one or more off-center flow tubes 44 that allow fluid communication between body cavities 24, 28. Flow bore 26 allows fluid to be conducted through the reamer 10 and to drill bit 202. Flow tube 44 extends through the interior of housing 12, preferably on one side of axis 17, and is integrally formed with the interior of housing 12. A flow direction tube 23 is received in the upstream end of housing 12 to direct fluid flow into flow tube 44. Flow direction tube 23 is held in place by adapter sub 21. The downstream end of flow direction tube 23 includes an angled aperture 29 which communicates the upstream end of flow tube 44 with the upstream body cavity 24 communicating with flowbore 26. The downstream end of flow tube 44 communicates with the downstream body cavity 28 of housing 12. It should be appreciated that additional flow tubes may extend through housing 12 with flow direction tube 23 also directing flow into such additional flow tubes.

The flow tube 44 is off center to allow adjustable and expandable blades 40, 42 to have adequate size and range of radial motion, i.e. stroke. Preferably, housing 12 provides sufficient room for blades 40, 42 to be completely retracted into housing 12 in their collapsed or unextended position as shown in FIGS. 1–3. Providing the flow tube 44 off center requires that fluid flow through flowbore 26 be redirected by flow direction tube 23. Although the flow area through flow tube 44 is smaller than that of flowbore 26, its flow area is large enough so that there is little increase in velocity of fluid flow through flow tube 44, and so that there is a small pressure drop and no substantial erosion occurs from flow through flow tube 44. The flow is sufficient to cool the bit 202, remove cuttings from the borehole 210 and, in the case of a steerable system placed downhole from reamer 10, to power the down-hole motor (not shown).

Figure 4:
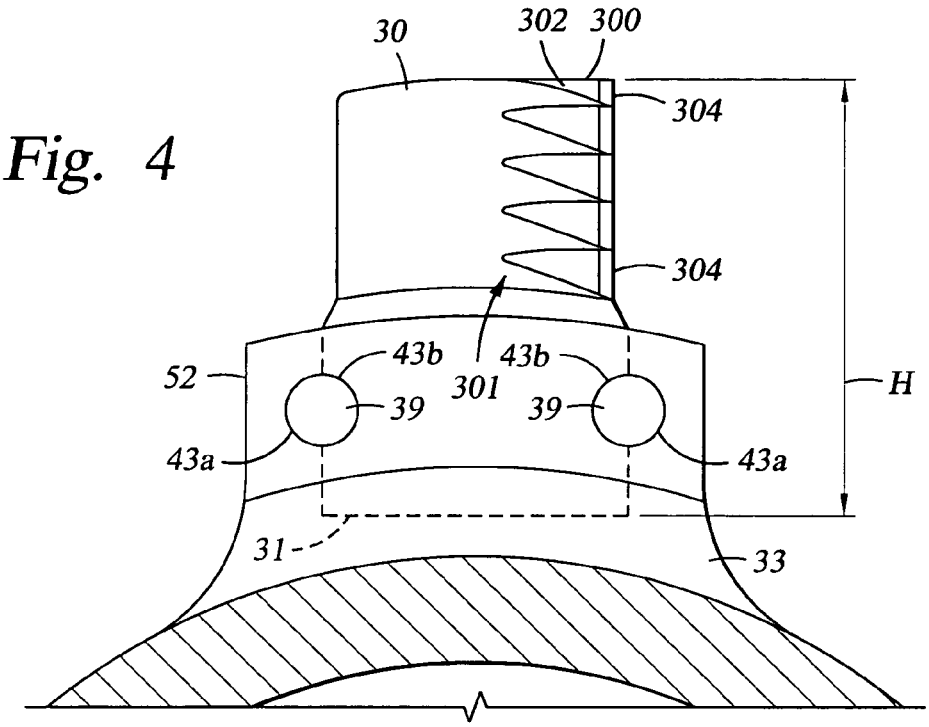
FIG. 4 is an end view of the fixed blade of the reamer shown in FIGS. 1–3.
Figure 5:
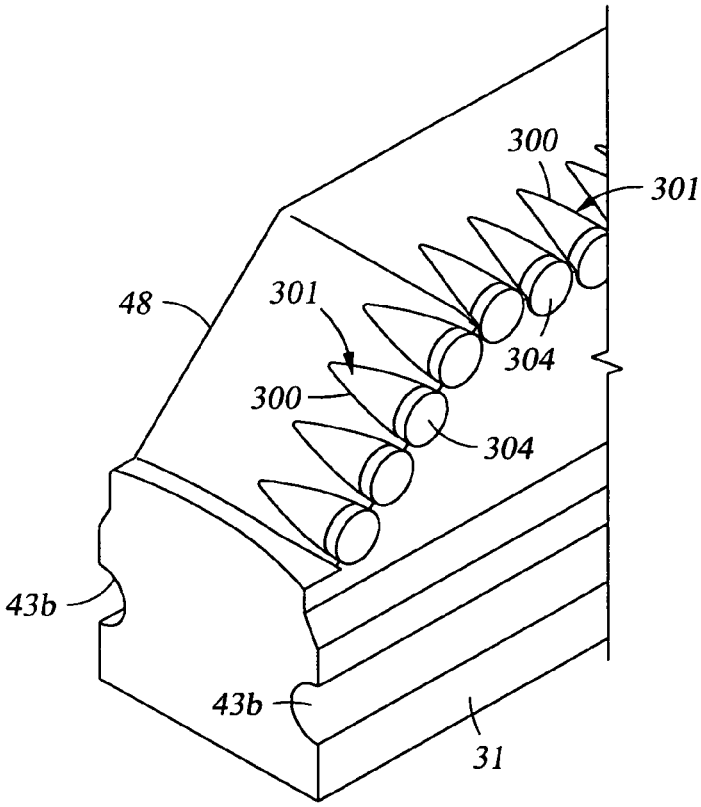
FIG. 5 is a perspective view of the end of the fixed reamer blade shown in FIG. 4 having cutter elements along its outermost edge.

Referring now to FIGS. 3–5, although fixed blade 30 may be formed as an integral part of housing 12, it is preferable that blade 30 include a replaceable blade insert 31 disposed in a slot 33 in an upset 52 radially extending from housing 12. This arrangement permits adjusting the amount of projection of fixed blade 30 from housing 12. As explained in detail in U.S. Pat. No. 6,213,226, it is preferred that blade insert 31 be secured in slot 33 by dowel pins 39 that are disposed in C-shaped grooves 43*a, b*. Groove 43*a* is a longitudinal groove formed in the side wall forming slot 33 and groove 43*b* is a correspondingly sized and shaped longitudinal groove formed in the side of blade insert 31. Dowel pins 39 extend the full length of grooves 43*a*, 43*b*. Other means, such as bolts threaded into tapped holes formed in housing 12 may be employed to secure blade insert 31 in housing 12. To increase the radial reach of blade 30, the dowel pins 39 and the blade insert 31 are removed from upset 52, and a different blade insert 31 (one having height "H" that is greater or less than the height of the blade insert that it is replacing) is installed in slot 33 of upset 52, and the dowell pins 39 are reinstalled.

Referring more specifically to FIGS. 4 and 5, replaceable blade insert 31 includes a row of cutter elements 300 preferably formed along the outermost edge of the insert. Additional rows of such cutter elements may also be included on blade insert 31. Cutter elements 300 are mounted within pockets 301 which are formed along blade insert 31. Cutter elements 300 are constructed by conventional methods and each typically includes a generally cylindrical base or support 302 having one end secured within a pocket 301 by brazing or similar means. The support 302 may be comprised of a sintered tungsten carbide or other suitable material. Attached to the opposite end of the support 302 is a layer of extremely hard material, preferably a synthetic polycrystalline diamond material which forms the cutting face 304 of element 300. Such cutter elements 300 are generally known as polycrystalline diamond composite compacts, or PDCs. Methods of manufacturing PDCs and synthetic diamond for use in such compacts have long been known. Examples of these methods are described, for example, in U.S. Pat. Nos. 5,007,207, 4,972,637, 4,525,178, 4,036,937, 3,819,814 and 2,947,608, all of which are incorporated herein by this reference. PDCs are commercially available from a number of suppliers including, for example, Smith Sii Megadiamond, Inc., General Electric Company, DeBeers Industrial Diamond Division, or Dennis Tool Company.

As best shown in FIG. 3, housing 12 includes one or more nozzles 55 (one shown) for directing the flow of drilling fluid upward and onto cutter elements 300 so as to sweep cuttings and debris past the cutter elements and to keep their cutting faces from becoming caked with formation material and lessening their cutter effectiveness. Nozzle 55 is in fluid communication with flow tubes 44 so as to supply drilling fluid to nozzle 55. Although not shown, an additional nozzle may be placed elsewhere in the housing, such as substantially at the midpoint of fixed blade 30.

Figure 8:
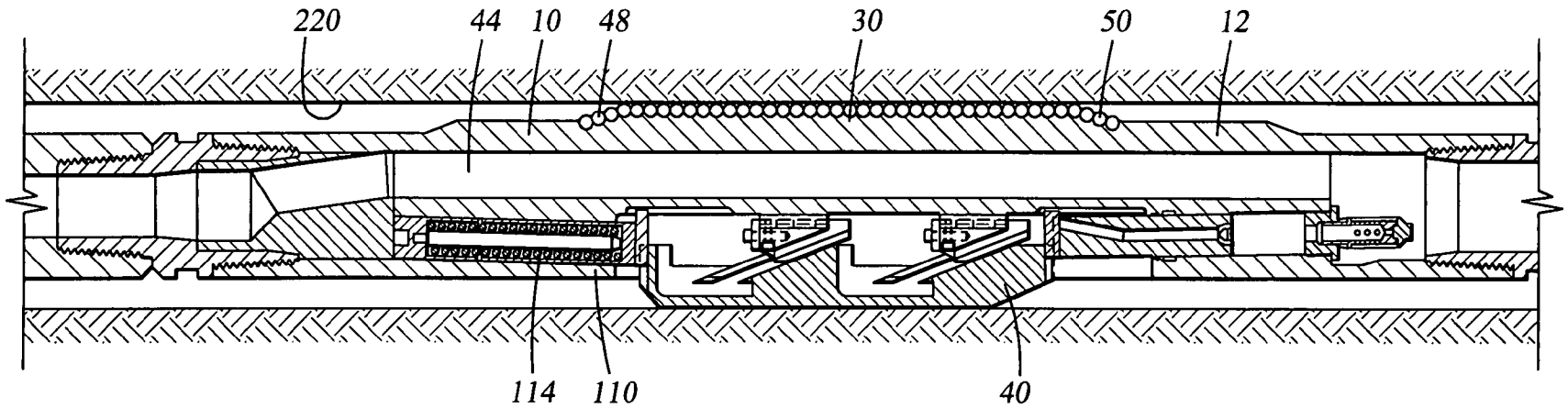
FIG. 8 is an enlarged longitudinal cross sectional view of the reamer shown in FIGS. 1 and 2 with the adjustable blades extended.

As shown in FIGS. 3 and 8, fixed blade 30 having cutter elements 300 is preferably longer than extendable blades 40, 42. More particularly, as shown in FIG. 8, it is preferred that fixed blade 30 extend beyond the ends of adjustable blades 40, 42 in both the uphole and the downhole direction. Such axial overlap of the length of the fixed blade 30 having the cutter elements as compared to the extending blades 40, 42 insures that the fixed blade supports more of the axial load than the extendable blades so as to enhance the cutting action of reamer 10.

Referring again to FIGS. 2 and 3, the extendable and adjustable blades 40, 42 are housed in two axially extending pockets or slots 60, 62 extending radially through the mid-portion of housing 12 on one side of axis 17. Because the adjustable blades 40, 42 and slots 60, 62, respectively, are alike, only adjustable blade 40 and slot 60 will be described in detail for the sake of conciseness. Slot 60 has a rectangular cross-section with parallel sidewalls 64, 66 and a base wall 68. Blade slot 60 communicates with a return cylinder 70 at its upper end, and with an actuator cylinder 72 at its lower end. Actuator cylinder 72 slidingly houses extender piston 104. Slot 60 further includes a pair of cam members 74, 76, each forming a inclined surface or ramp 78, 80, respectively. Although cam members 74, 76 may be integral to housing 12, cam members 74, 76 preferably include a cross-slot member and a replaceable ramp member. For a detailed description regarding the structure and operation of cam members 74, 76, reference is made to U.S. Pat. No. 6,213,226.

Figure 6:
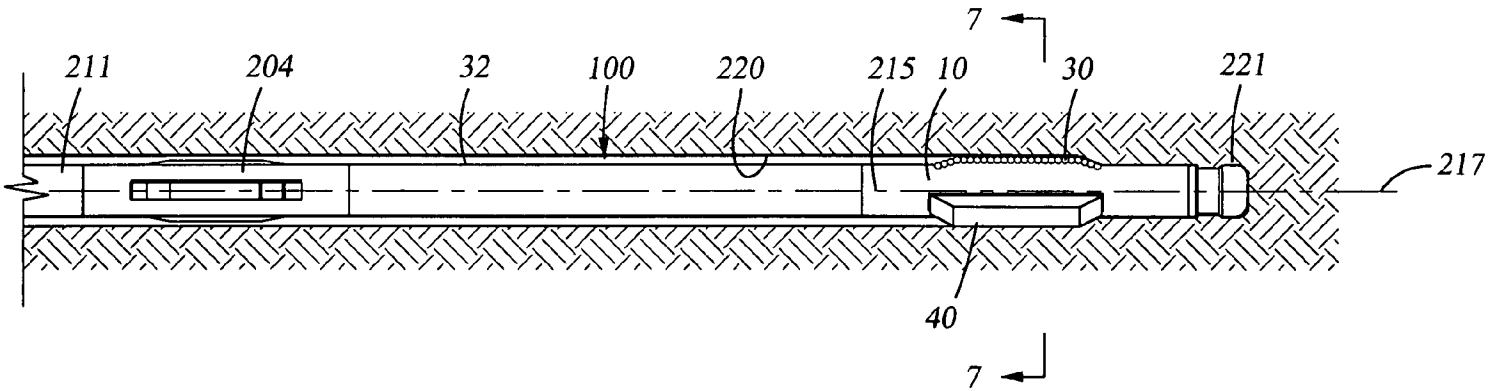
FIG. 6 is a diagrammatic elevation view, partially in cross section, of the bottom hole assembly shown in FIG. 1 with the adjustable blades in the extended position, and with the assembly extending into and forming a new borehole beneath the cased borehole.

Referring still to FIGS. 2 and 3, adjustable blade 40 is positioned within slot 60. Blade 40 is a generally elongated, planar member having a pair of notches 82, 84 in its base 86. Notches 82, 84 each form a ramp or inclined surface 88, 90, respectively, for receiving and cammingly engaging the corresponding including surfaces 78, 80 of cam members 74, 76, respectively. The corresponding ramp surfaces 78, 80 and 88, 90 are inclined or slanted at a predetermined angle relative to axis 17 such that movement of blade 40 against cam members 74, 76 cause blade 40 to move radially outward or inward a predetermined distance or stroke, as described in more detail in U.S. Pat. No. 6,213,226. Blades 40,42 are retained in their contracted position shown in FIGS. 1–3 until reamer 10 has passed below the existing casing string 209, such as shown in FIG. 6.

Referring to FIGS. 3 and 8, in operation, blades 40, 42 are actuated by a pump (not shown) at the well bore surface. Drilling fluids are pumped down through the drill string and through flowbore 26 and flow tube 44. Pressure of the drilling fluids acts upon the downstream end 106 of extender piston 104. The drilling fluids exit the lower end of the drilling assembly 100 and flow up annulus 32 to the surface causing a pressure differential or drop. The pressure differential is due to the flowing of the drilling fluid through the bit nozzles and through a downhole motor (in the case of directional drilling) and, in this embodiment, the pressure differential is not generated by any restriction in the reamer 10 itself. The pressure of the drilling fluids flowing through the drill string is therefore greater than the pressure in the annulus 32, thereby creating the pressure differential. The extender piston 104 is responsive to this pressure differential. The pressure differential, acting on extender piston 104, causes it to move upwardly within actuator cylinder 72. The upward movement of extender piston 104 causes it to engage the lower terminal end of blade 40 such that, once there is a sufficient pressure drop across the bit, piston 104 will force blade 40 upwardly (to the left as viewed in FIG. 3). In the embodiment shown in FIG. 1–3, a fluid pressure of approximately 200 psi in housing 12 is sufficient to cause blades 40, 42 to extend.

As blade 40 moves upwardly, it cams radially outward on ramps 88, 90 into a loaded or extended position (FIG. 8). As best shown in FIGS. 3 and 8, as blade 40 moves axially upward, the upstream end of blade 40 spring forces retainer 114 into return cylinder 70, thereby compressing return spring 110. It should be appreciated that the fluid flow (gallons per minute) through the drill string must be great enough to produce a large enough pressure drop for piston 104 to force the blade 40 against return spring 110 and to compress spring 110 to allow blade 40 to extend. With blades 40, 42 extended, eccentric reamer 10 has an increased diameter 19 (FIG. 7) that is greater than diameter 14 of reamer 10 when blades 40, 42 are in their retracted position.

To move blade 40 back to its contracted position, the pump at the surface is turned off or flow rate reduced to the degree necessary to eliminate the blade-actuating pressure differential across extender piston 104. Compressed return spring 110 then forces spring retainer 114 axially downward against the upper terminal end of blade 40, causing blade 40 to move downwardly on ramp surfaces 88, 90 and back into slot 60 to a retracted, unextended position shown in FIGS. 1–3.

Blades 40, 42 are individually housed in their respective slots 60, 62 of housing 12, and are actuated by separate dedicated extender pistons 104 and return springs 110. However, since it is preferable that each be responsive to the same differential pressure, adjustable blades 40, 42 will tend to move in unison to either the extended or contracted position.

It should be appreciated that the control methodology described in U.S. Pat. No. 5,318,137, the entire disclosure of which being incorporated herein by this reference, may be adapted for use with reamer 10 of the present invention whereby an adjustable stop, controlled from the surface, may adjustably limit the upward axial movement of blades 40, 42, thereby also limiting the radial movement of blades 40, 42 on ramps 88, 90 as desired. The positioning of the adjustable stop may be responsive to commands from the surface such that blades 40, 42 may be multi-positional and extended or retracted to a number of different radial distances, on command.

Operation of bottom hole assembly 100 for enlarging a borehole beneath a existing cased borehole 210 will now be described. The same procedure and assembly may likewise be employed to enlarge a borehole beneath a preexisting open (not cased) borehole. Referring momentarily to FIG. 1, bottom hole assembly 100 is shown passing through an existing cased borehole 210 having a central axis 211. Fixed blade 30 extends from housing 12 of reamer 10 while adjustable blades 40, 42 remain in their contracted (unextended) positions during pass through. The primary or "pass through" diameter 14 (FIG. 2) of reamer 10 is slightly smaller than the inner diameter of the existing casing 209, the pass-through diameter 14 being defined when blades 40, 42 of reamer 10 are in their contracted positions. As shown in FIG. 2, fixed blade 30 and adjustable blades 40, 42 provide drilling assembly 100 with three areas of contact 131, 141, 143 with casing 209 of the borehole 210 and, in this manner, act as a stabilizer. Contact areas 131, 141 and 143 define a central contact axis or center 215 of reamer 10 which is coincident or aligned with axis 211 of the cased borehole 210. As shown in FIG. 1, bit 202 includes a central axis 217 that is deflected by reamer 10 such that axis 217 is not aligned with borehole axis 211 or reamer contact axis 215. This deflection is necessary to permit the drilling assembly to pass through casing 209, and locating upper fixed blade stabilizer 204 approximately thirty feet or more away from bit 202 facilitates such deflection.

Figure 7:
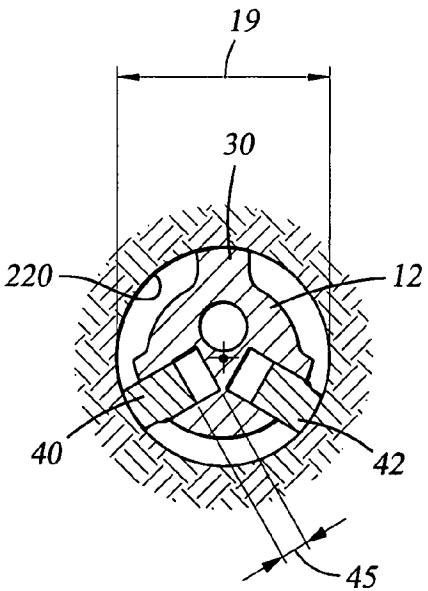
FIG. 7 is a cross-sectional view taken at plane 7—7 in FIG. 6 showing the eccentric reamer in the borehole with the adjustable blades shown in the extended position.

Referring now to FIGS. 6–8, bottom hole assembly 100 is shown drilling a new borehole 220 beneath the existing cased borehole 210 that was depicted in FIG. 1. In FIGS. 6–8, the adjustable blades 40, 42 have been extended as previously described. As best shown in FIG. 6, blades 40, 42 extend radially outward a predetermined distance as required to properly shift bit axis 217 to align with axis 211 of the cased borehole 210. Simultaneously, extending blades 40, 42 likewise shifts the location of reamer axis 215 defined by contact area 131, 141, 143, such that axis 215 also becomes aligned with axis 211. As shown in FIG. 6, in this position, bit 202 drills a pilot borehole 221 that is coaxially aligned with larger diameter borehole 220 that is formed by reamer blades 30, 40 and 42 (and in particular by cutter elements 300 on blade 30) as the bottom hole assembly 100 is rotated.

When borehole 220 has been drilled to the desired depth, bottom hole assembly 100 may be pulled upwardly (from right to left in the drawing of FIG. 6). As this occurs, bottom hole assembly 100 is rotated so that blades 30, 40, 42, and particularly the cutter elements 300 on fixed blade 30, back ream borehole 220 to remove formation projections, and thus clean the borehole and better prepare it for receiving the next casing string. The stability necessary for back reaming using fixed blade 30 is provided by the extended blades 40, 42.

Although reamer 10 has been described to this point as having cutter elements 300 mounted only on fixed blade 30, in other preferred embodiments, cutter elements 300 are likewise fixed on one or more of extendable blades 40, 42. For example, referring to FIG. 9, a drilling assembly 400 is shown to include an eccentric adjustable diameter blade reamer 402 having extendable blades 440, 442 that each include a series of cutter elements 300, such as the PDC cutters previously described, disposed along the radially outermost edges of the blades. In other respects, blades 440, 442 are identical to blade 40, 42 previously described with respect to FIG. 1–8. Likewise, reamer 402 and drilling assembly 400 may be identical to reamer 10 and bottom hole assembly 100, respectively, previously described.

The reamer assemblies 10 and 402 described above may be employed with a standard bit 202 and provide the functionality of forming an enlarged borehole beneath an existing borehole (cased or open) without the necessity of using a bi-centered bit. In effect, the cutter elements 300 disposed on fixed blade 30 (with or without cutter elements on the extendable blades) eliminates the need for the winged reamer section of the bi-center bit, and permits the drilling assembly to use a conventional bit or merely the pilot bit portion of a bi-centered bit. By eliminating the wing or reamer section of the bi-center bit, the drilling assembly is shortened by the length of the reamer section, thus placing the bit 202 closer to reamer 10, as well as closer to the downhole motor driving the bit. This provides several advantages, including versatility in bit selection, lower bending stresses on the downhole motor, bit and shaft, enhanced steerability and directional control, as examples.

Eliminating the reamer section of a bi-centered bit also provides additional advantages. A bi-center bit is not mass centered balanced because of the extending reamer wing. Upon rotating the bi-centered bit, the mass imbalance may tend to cause the bit to wobble and deviate from the desired path. By contrast, with the eccentric adjustable blade reamer 10, having extendable blades 40,42 that are extended in order to form the new, increased diameter borehole 220, the bottom hole assembly 100 is substantially mass center balanced, meaning that the center of gravity of reamer 10 is generally aligned with the center axis of the reamer housing 12 and borehole axis 211. As the reamer 10 is rotated about its axis, it will thus be rotated about its mass center, Such that the bottom hole assembly 100 will be less likely to deviate from the desired drilling path.

Figure 9:
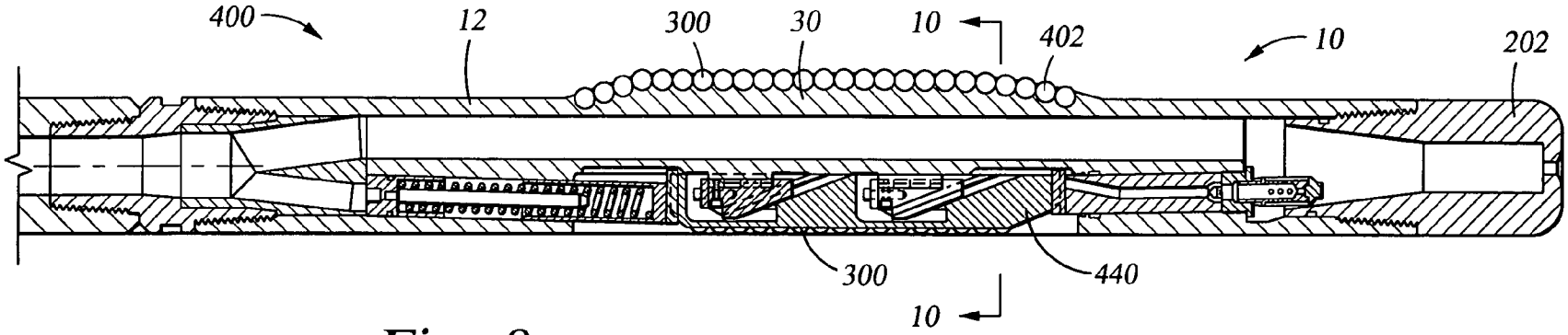
FIG. 9 is an enlarged, cross-sectional view of an alternative embodiment of an eccentric, adjustable diameter, reamer including cutting elements on the fixed and the extendable blades.
Figure 10:
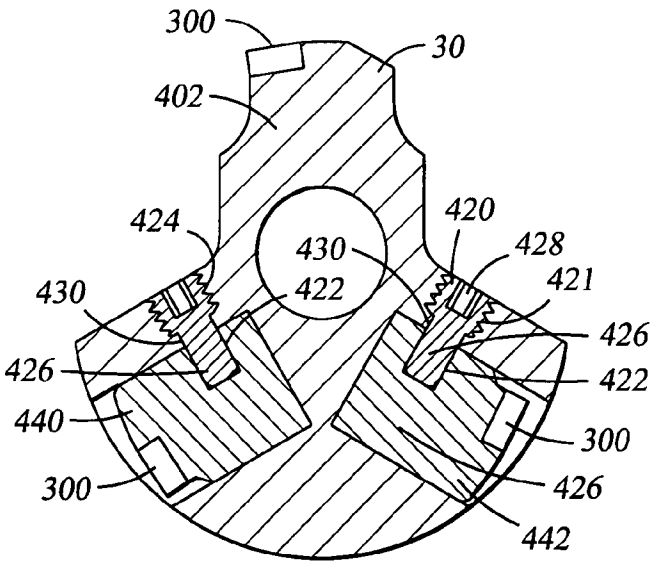
FIG. 10 is a cross-sectional view taken along plane 10—10 in FIG. 9 showing the adjustable blades locked in the contracted or unextended position by shear pins.

Further, in the drilling assembly 400 having a reamer 402 with cutter elements 300 on both the fixed blade 30 and the extendable blades 440, 442, such as with the assembly shown in FIGS. 9 and 10, it is also possible to "force balance" the assembly, such that the forces imposed on the reamer blades by the formation material substantially cancel one another, or at least approach a net zero vector sum. Thus, by balancing the resultant force on the blades 30, 440, 442, the assembly itself may be described as having a balanced cutting force with the reamer 402 rotating about the cutting force center. This also leads to stability of the tool and greater ability to maintain the desired drilling path.

As noted previously, it is common practice to install a casing shoe at the lowermost end of a casing string and to thereafter drill out the end of the shoe when it is desired to create additional borehole and install further casing. The conventional bits employed for drilling through the casing shoe typically require increased fluid flow through the drill string, the mud motor (when employed), and the bit in order to most efficiently drill out the shoe. As previously described herein, increased fluid pressure is employed in order to actuate and expand the adjustable blades 40, 42 of eccentric adjustable blade reamer 10. Thus, when employing reamer 10 in an assembly to drill through a casing shoe and form an enlarged borehole beneath the casing shoe, it is important to ensure that the adjustable blades are not extended before the drilling of the shoe is completed. Premature extension of the blades could damage the cutter elements 300, making them less effective when drilling the new, enlarged borehole.

Accordingly, certain embodiments of the present invention contemplate the use of a means for preventing blade extension until the casing shoe has been completely drilled through. Referring to FIG. 10, reamer 402 is shown having fixed blade 30 and extendable blades 440, 442 each including rows of cutter elements 300 as previously described. Each extendable blade 440, 442 is retained in its retracted position by a retainer 420 which, in this embodiment, is a shear pin 420 that passes through a bore 421 in housing 12 and through aligned bore 422 formed in the side of adjustable blades 440, 442. The shear pin 420 includes a threaded head 424 that is threaded into the bore 421 in the housing, and a shank 426 extending into the bore 422 formed in adjustable blade 440, 442. Bore 422 is at least approximately 0.020 inches larger in diameter than shank portion 426. The head 424 of the shear pin 420 includes an aperture 428 for receiving a tool for threading the head into the bore 421 of housing 12. The shear pin 420 further includes a reduced diameter shank portion 430 which provides a weak link for shearing the pin 420 at a predetermined force as caused by a predetermined drilling fluid pressure and corresponding pressure drop.

The reduced diameter portion 430 of the shear pin is sized such that, even with increased fluid flow required for drilling through the casing shoe, extendable blades 440, 442 will be retained in their contracted position. After the casing shoe has been drilled through, the pressure of drilling fluid may be increased to a still higher flow rate and pressure so as to cause the shear pins 420 to shear at the weak link 430 and cause the blades 40, 42 to extend. For example, a fluid pressure within housing 12 of approximately 450 psi. may be employed to cause shear pins 420 to shear where reduced diameter portion is approximately ⅜ inches in diameter and made of any of a variety of metals. Thereafter the pumps may be controlled at the surface to lower the fluid pressures and flow rates to those required for drilling a new borehole and for maintaining blades 40,42 extended, such pressure typically being less that that required to drill through the casing shoe and less than that required to sever the shear pins.

An advantage of providing the shear pins to extend through housing 12 is that it allows for easy replacement of the pins in the field. This is desirable in that, should a shear pin become severed prematurely, thereby allowing the blade to extend prematurely, the drilling assembly can be pulled from the hole and easily replaced in the field without disassembly of the assembly. Further, the shear pin may be replaced with a pin having a greater shear pressure in order to prevent another premature accuation of the blade. If the means for preventing the blades from extending prematurely were not accessible from outside the housing 12, it would require the disassembly of the reamer 400, which would lead to delays and additional expense. Alternatively, it would require the expense of having an additional reamer retained on site, one having shear pins having a greater predetermined actuation pressure.

The shear pin shank 426 and the bore 422 are sized and provided such that, once shank 426 is sheared at the weak link 430, the adjustable blades 40,42 may move in and out of their respective slots 60,62 without the remaining pieces of the shear pin projecting into the interface between the blade and its slot. Once sheared, the lower portion of shank 426 will be loose within the bore 422 but will not interfere with the movement of the blades. After the tool is retrieved to the surface, and upon removal of shear pin head 424 from threaded bore 421 of housing 12, the now severed shank 426 will fall out of bores 421, 422 or can be removed by magnetic force.

Figure 11:
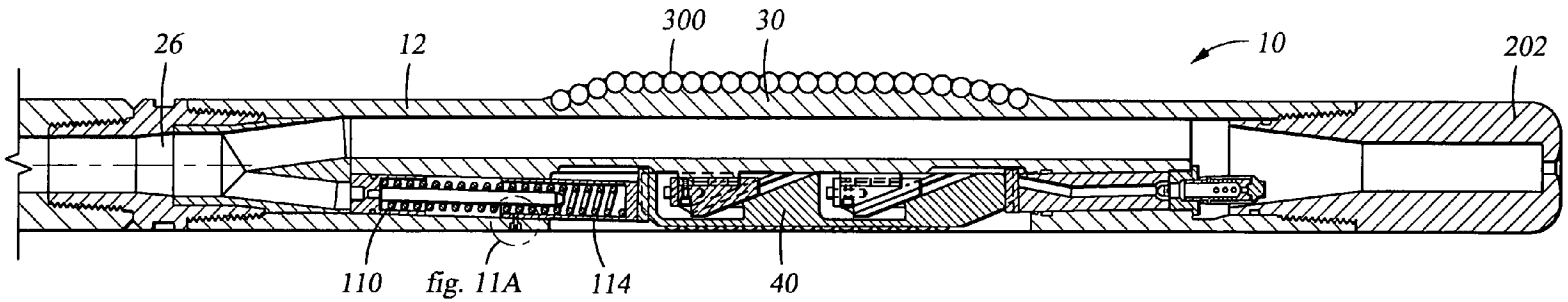
FIG. 11 is a cross-sectional view of another alternative embodiment of a bottom hole assembly having an eccentric, adjustable diameter reamer with the adjustable blades shown locked in the contracted position by shear pins.
Figure 11A:
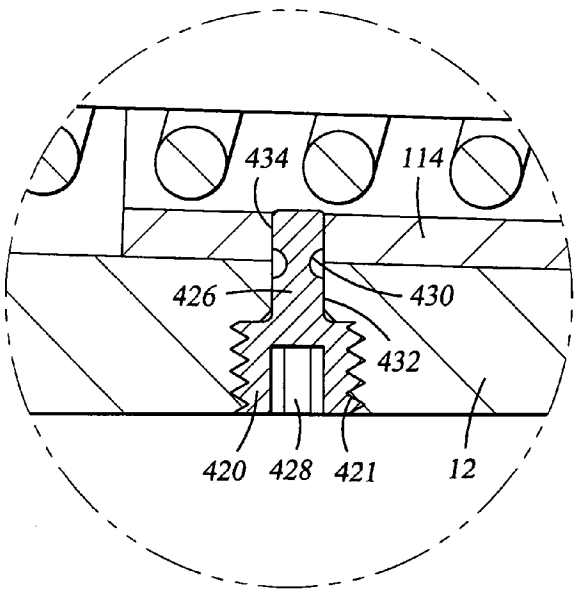

Although the means for retaining extendable blades in their contracted position has been described with reference to a reamer 400 having cutter elements 300 on the extendable blades, such retaining means may also be employed on extendable blades that do not support cutter elements. Further, shear pins or similar retainer means may be employed in other portions of the reamer. For example, referring to FIG. 11, an alternative arrangement for retaining blades 40, 42 in their contracted positions is shown. As previously described, each extendable blade 40,42 engages a spring loaded retainer 114 at its upper end that is slidably disposed within return cylinder 70. As shown in FIG. 11, housing 12 and retainer 114 are provided with bores 432, 434 respectively, that are aligned when the blades are in their contracted or unextended positions. Shear pins, such as pins 420 previously described, are disposed in the aligned bores with the shank 426 being received in bore 434 of retainer 114 and head 424 threadedly engaged in bore 432. The shank portion 426 includes reduced diameter portion 430 providing the weak link for shearing the pin when a predetermined force, caused by predetermined drilling fluid pressure and corresponding pressure differential, causes blade 40 to press against spring retainer 114. In this manner, the shear pin 420 provides a predetermined pressure rating to prevent spring retainer 114 from moving or compressing return spring 110 until the pressure in the assembly causes the retainer 114 to shear the pin and allow the retainer to move. Once again, it is desirable that the shear pin 420 extend through the housing 12 of the reamer such that the pins 420 can be easily and quickly replaced in the field without disassembly of the reamer.

Figure 12A:
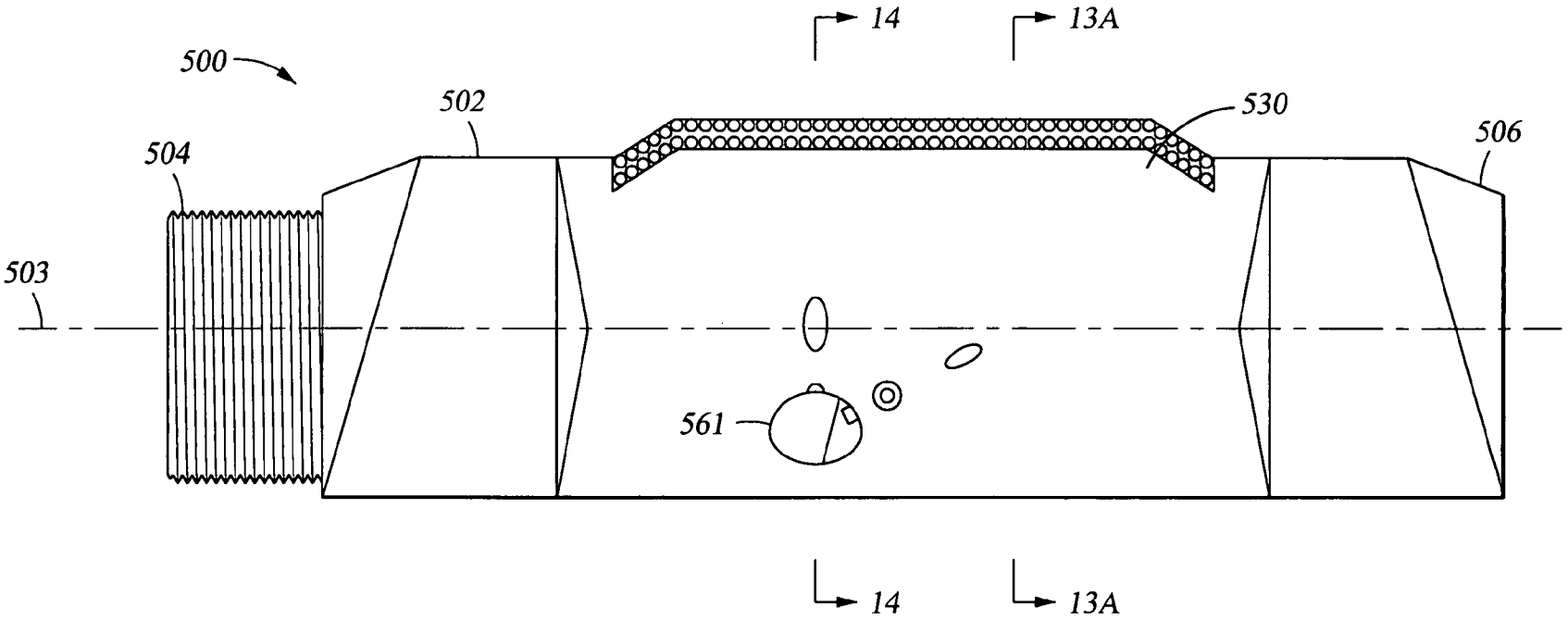
FIG. 12A is an elevation view showing an alternative eccentric, adjustable diameter reamer assembly having movable and extendable piston members in the retracted position.

The eccentric reamer of the present invention may employ movable members other than blades to provide the desired increased overall diameter of the reamer assembly. Referring to FIG. 12A, there is shown a reamer assembly 500 for use in a variety of bottom hole assemblies. For example, reamer 500 may be substituted for reamer 10 previously described with respect to FIG. 1. As shown in FIG. 12A, eccentric reamer 500 includes a body 502 with upper end 504, lower end 506 and longitudinal axis 503. When employed in the drilling assembly shown in FIG. 1, upper end 504 threadingly connects with drill collar or other tubular element 16, and lower end threadingly engages drill bit 202.

Figure 12B:
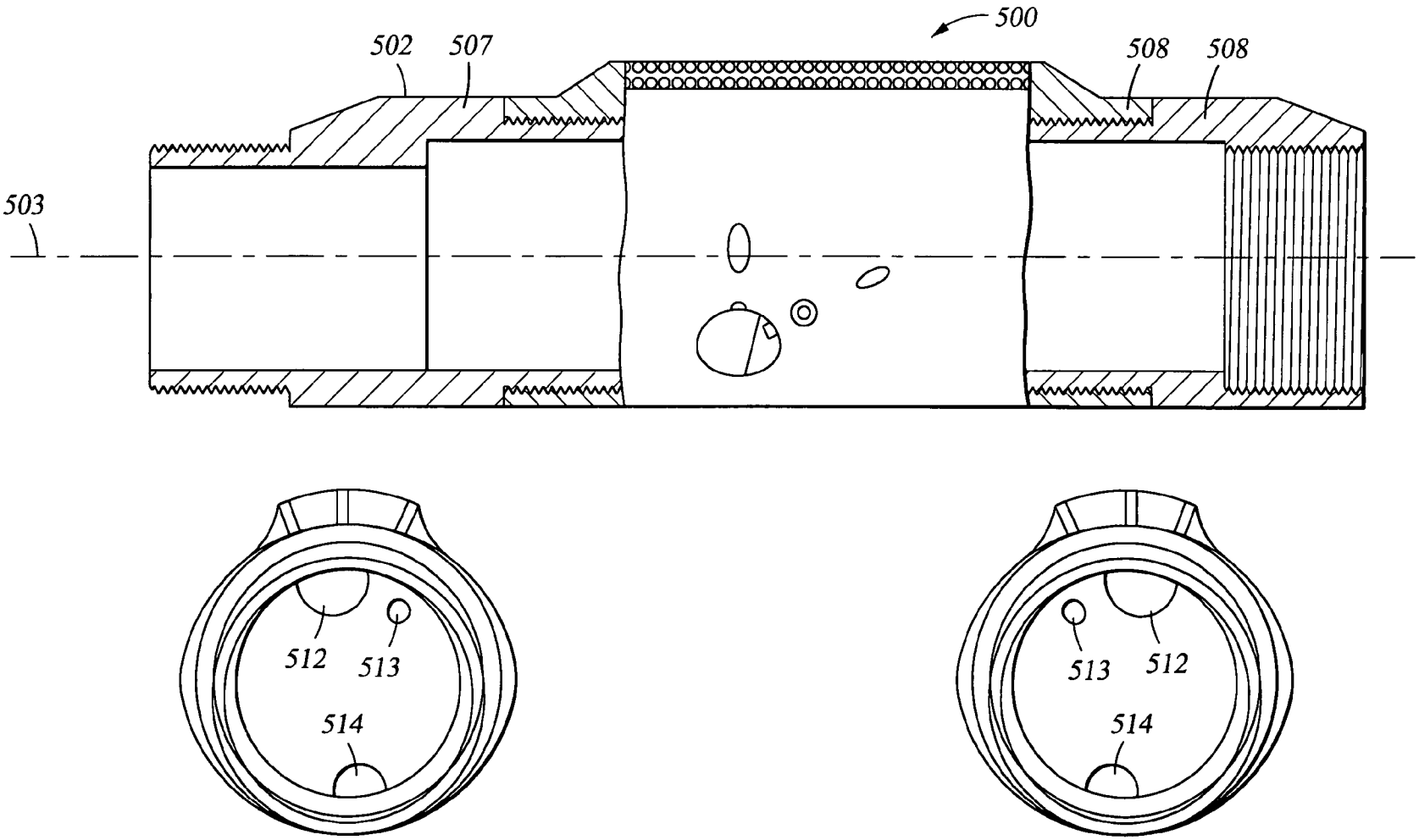
FIG. 12B is a diagrammatic, partial cross-sectional view of the reamer assembly shown in FIG. 12A.

Referring now to FIG. 12B, housing body 502 comprises central body portion 508 that threadingly engages upper connection housing 507 and lower connection housing 509. Upper and lower housing portions 507, 509 are provided generally to provide an offset necessary to enable flow bores 512, 513, 514, described below, to pass completely through reamer assembly 500 and to connect with fluid passageways above and below reamer assembly 500.

Figure 13A:
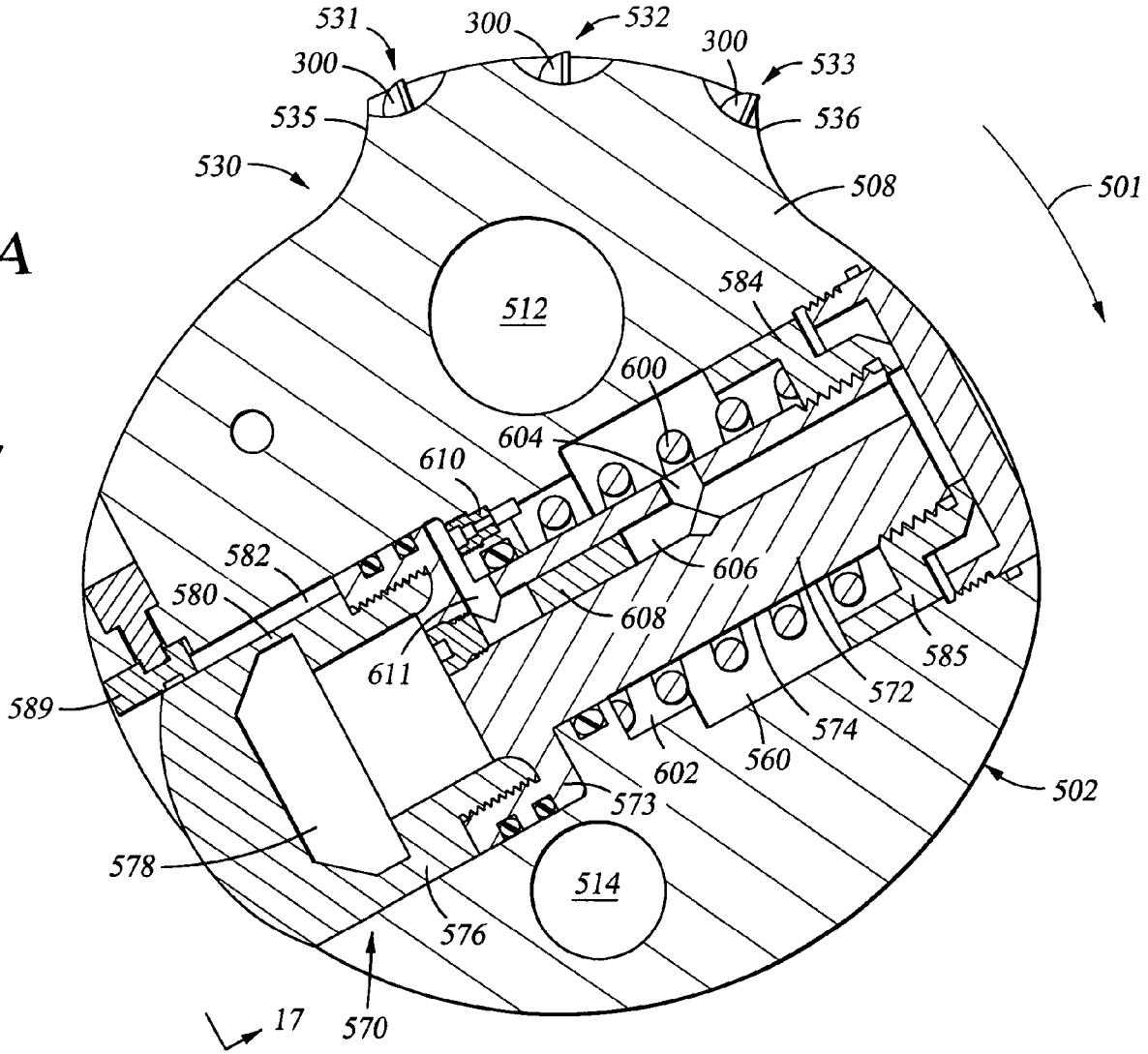
FIG. 13A is a cross-sectional view taken at plane 13A—13A in FIG. 12A.
Figure 14:
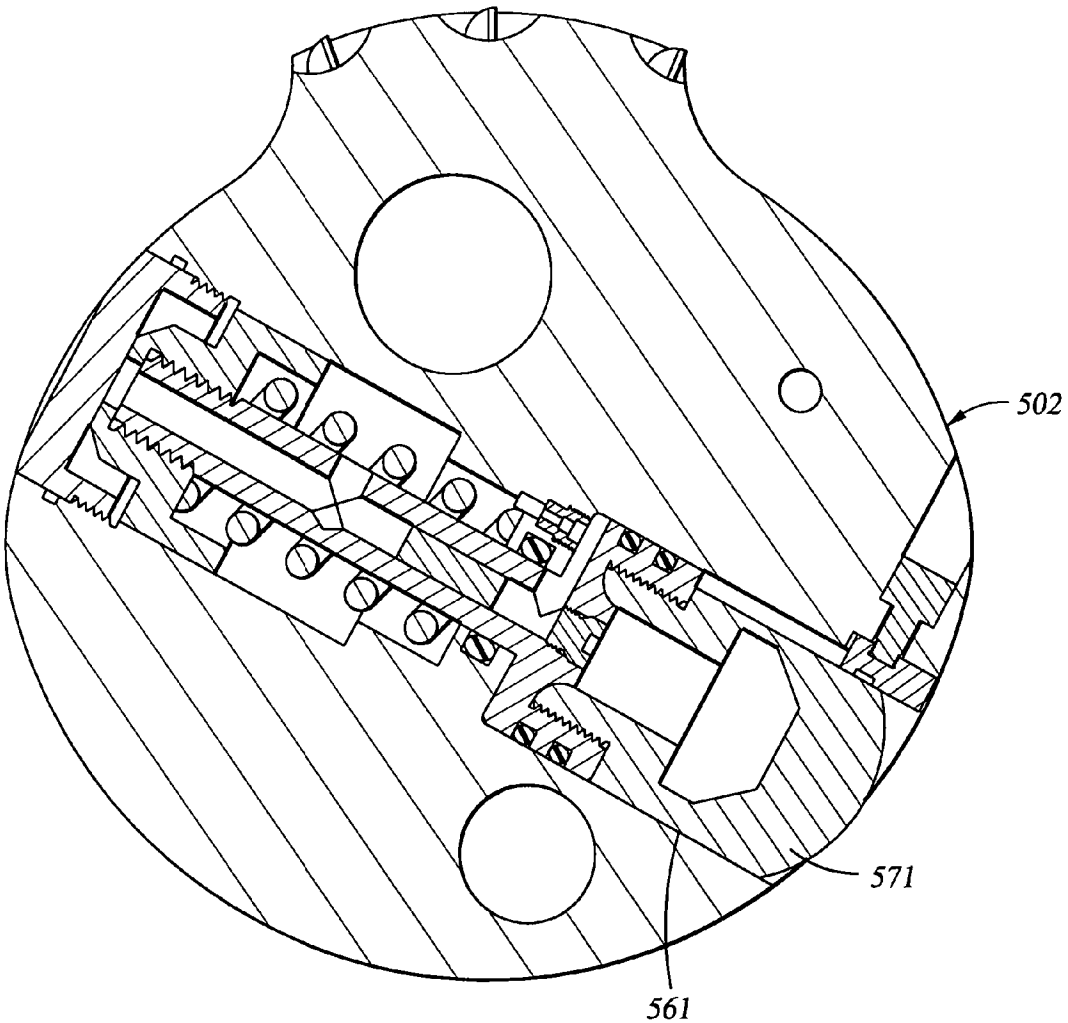
FIG. 14 is a cross-sectional view taken at plane 14—14 in FIG. 12A.

Referring to FIGS. 13A, 14, body 502 includes flow bores 512, 513, 514 extending therethrough for communicating drilling fluid through body 502 and to drill bit 202. Extending from central body portion 508 is fixed blade 530. As best shown in FIG. 13A, fixed blade 530 extends from and, in this embodiment, is formed integrally with central body portion 508 and includes three rows 531–533 of PDC cutter elements 300. Rows 531 and 533 are positioned generally along the edges 535,536 of blade 530, while row 532 is disposed centrally between rows 531, 533. As understood, the cutting faces of cutter elements 300 face in the direction of rotation of reamer assembly 500 as indicated by arrow 501.

Figure 13B:
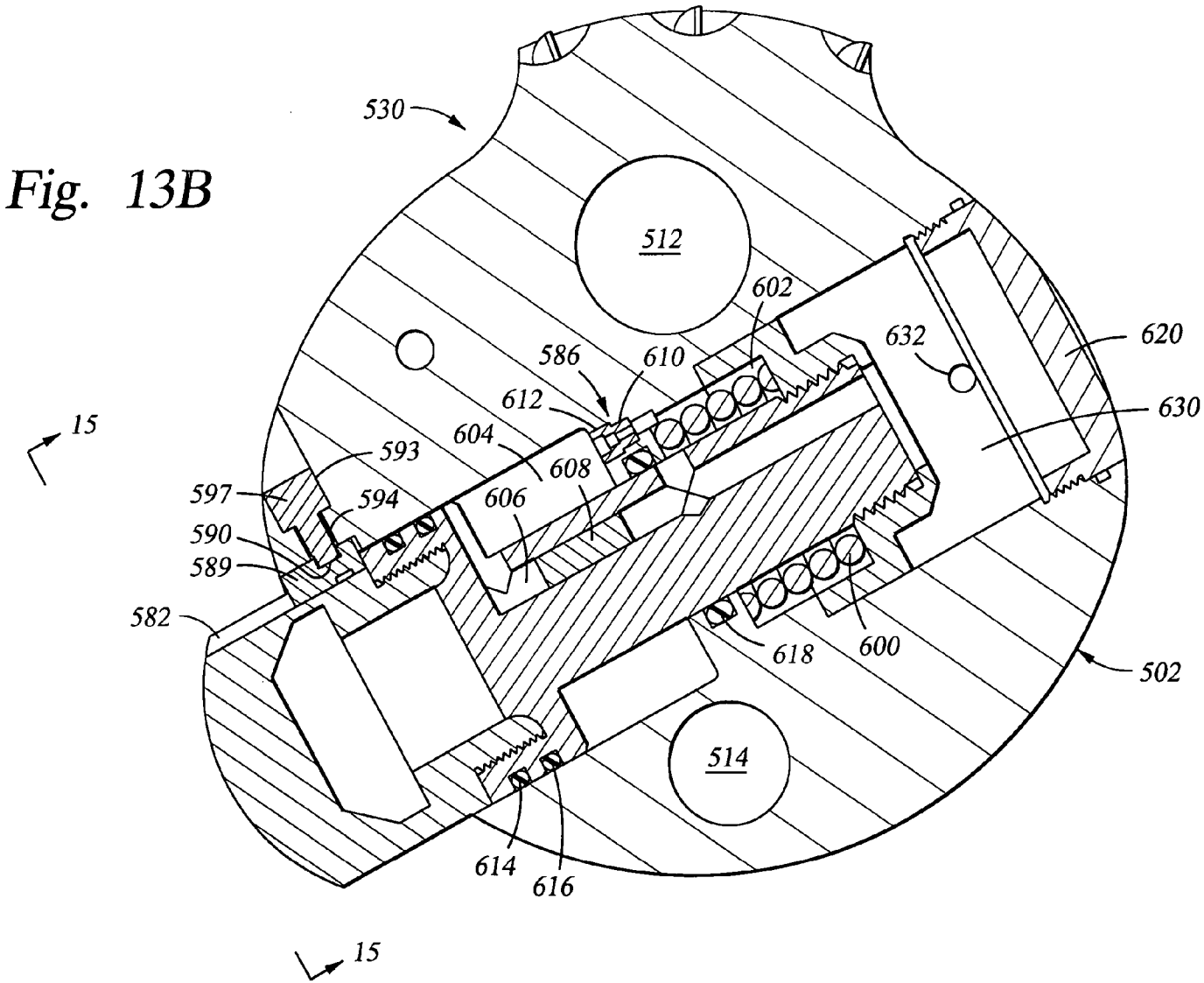
FIG. 13B is a cross-sectional view similar to that shown in FIG. 13A, but shown here with the piston members in its extended position.

Referring now to FIGS. 13A and 13B, reamer body 502 is shown to include a piston bore 560 that houses piston 570. Piston 570 is positioned from fixed blade 530 an angular distance of approximately 60 °–150°. Reamer assembly 500 includes a second piston bore 561 (FIG. 12A) housing a second piston 571 shown in FIG. 14. Bore 561 is formed approximately 60 °–150° from bore 560 and from fixed blade 530. Piston bores 560, 561 are axially positioned at locations between the ends of fixed blade 530 so that the series of cutter elements 300 axially overlap the locations where pistons 570, 571 engage the borehole wall. Piston 571 is substantially identical to piston 570, but may be smaller in diameter due to space limitations. Because of the substantial identity, between pistons 570, 571 only piston 570 need be described in detail.

Referring again to FIG. 13A, piston 570 is shown in its retracted position housed completely within piston bore 560 in reamer body 502. Piston 570 generally includes a piston shaft 572 having a large diameter portion 573 and a reduced diameter portion 574. Large diameter portion 573 threadingly engages piston head 576. Piston head 576 includes a central cavity 578 that includes a thin-walled segment 580. Piston head 576 further includes a keyway 582 in its outer surface for receiving cylindrical key 589. Piston shaft 572 includes an axial bore 606 that is intersected by radial bores 609, 611. Disposed in axial bore 606 is check valve 608. Piston cap 584 threadingly engages the end of shaft 572 opposite piston head 576. Piston cap 584 includes an extending flange 585 for retaining return spring 600 that is disposed about piston shaft 572 within spring chamber 602. Spring chamber 602 is in fluid communication with fluid chamber 604 (FIG. 13B) via fluid passageways 606, 609, 611 and via piston dampening orifice 610, described in more detail below. Orifice 610 forms a fluid path that is in parallel with the path formed by passageways 606, 609, 611. Shaft seal 618 prevents drilling fluid from passing between chambers 602, 604 other than through the above-described parallel paths.

Referring to FIG. 17, 18, eccentric reamer 500 includes a retainer 635 for retaining piston 570 in its retracted position until reamer 500 reaches the position in the borehole that it becomes desirable to expand its diameter. As best shown in FIG. 18, retainer 635 includes a slot 583 formed in piston head 576 for receiving the end of shear pin 640. Upon assembly, shear pin 640 is inserted in bore 645 formed in housing 502 such that the end of the shear pin is disposed in slot 583. Shear pin 583 includes a weakened segment 641 and is generally positioned in alignment with the interface between piston head 576 and piston bore 560. A locking bolt 642 is threaded into bore 641 for retaining shear pin 640 in the position described.

When it is desirable to extend piston 570, the drilling fluid pressure through reamer 500 is increased to a predetermined pressure. Referring to FIG. 13B, the pressure of the drilling fluids acts against piston shaft 572 via fluid chambers 630, 602, 604 and fluid passageway 632 which, as described previously, are in fluid communication with flow bores 512, 514. At the same time, drilling fluids pass through bit 212 and up the annulus between reamer 500 and the borehole wall Causing a pressure differential of a magnitude sufficient to cause shear pin 640 to be severed. Thereafter, the fluid pressure causes piston 570 to be extended such as piston head 576 extends out of piston bore 560 for engagement with the borehole wall.

A piston dampening means 586 is provided in reamer 500 to permit radial movement of piston 570 back into piston bore 560 even when the piston-actuating pressure differential exists, but such movement is restricted so as to permit only slow movement of the piston toward the contracted position. More specifically, the piston dampening means 586 includes check valve 608 and dampening orifice 610. Check valve 608 allows drilling fluid to flow from spring chamber 602 into fluid chamber 604 but prevents flow in the opposite direction. When piston 570 extends to its fullest extension, piston head 576 engages the borehole wall which, in turn, applies a radial force tending to push piston 570 back within the reamer body. Although it is desirable that piston 570 remain extended, some inward movement is permitted by the piston dampening means 586. More particularly, although check valve 608 is closed to fluid flow out of chamber 604 and back into chambers 602, 630, dampening orifice 610 provides a small opening to allow some fluid flow from chamber 604 into chamber 602 so that the piston 570 may slowly retract. When the borehole forces tending to push the piston into reamer body 502 lessen, the fluid pressures acting on the piston again extend it to its fully extended position. When it is desirable to remove the tool from the borehole or to raise it at least to a position where it must again enter the casing having a smaller diameter than the reamer's increased diameter, the drilling fluid pressure is decreased such that return spring 600 acting against piston cap 584 will return piston 570 to its fully retracted position.

Referring now to FIGS. 15 and 16, the portion of piston head 576 facing generally uphole includes a generally planer or flattened surface 650. Surface 650, which may also be parabolic shaped, is provided to enhance the ability to remove the tool from the borehole in the event that the reduced fluid pressure and return spring 600 fail to retract piston 570 completely. Surface 650 forms a camming surface such that, as the piston head engages the borehole wall while the reamer 500 is being withdrawn, the forces acting upon camming surface 650 will tend to push the piston back within the reamer body 502.

Given the advantages provided by camming surface 650, it is thus desirable to orient the piston head 576 so that surface 650 generally faces uphole and to prevent the piston head from rotating from that orientation during operation. Accordingly, referring again to FIGS. 13B and 15, piston head 576 includes a longitudinal channel or groove 582 along its outer surface that is aligned with a corresponding groove 587 (FIG. 15) in the reamer body 502. Upon assembly, cylindrical key 589 having an annular groove 590 is disposed in the bore formed by channels 582, 587. A retaining bolt having threaded head 593 and extending shaft 594 is disposed in bore 596 that is formed in reamer body 502. Threaded bolt head 593 threadingly engages body 502 with its shaft 594 extending into the groove 590 of the cylindrical key 589. In this manner, key 589 prevents rotation of the piston head, with retaining bolt 597 fixing key 589 in place.

As an additional precautionary means to prevent reamer 500 from becoming stuck in the borehole due to its extending pistons, piston head 576 is provided with a thin-walled segment 580 such that, should the piston head fail to properly retract, a sufficient upward force may be applied to the tool so as to cause piston head 576 to shear at the thin-walled segment 580 to allow the tool to be retrieved.

It is to be understood that while the embodiments above have been described with reference to a rotating drill string, the preferred embodiments of the reamer can likewise be employed using coiled tubing drilling assemblies. In particular, it may be desirable to employ the above-described reamers beneath a downhole motor in a bottom hole assembly operated on coiled tubing.

Further, each of the above-described embodiments having a fixed blade extending from the reamer housing may additionally include other fixed blades. For example, and referring to FIGS. 1 and 2, a reamer is contemplated having two such fixed blades 30, each of which having one or more rows of cutter elements 30 facing in the direction of rotation where the blades are separated, for example, by an angular measure of approximately 90° or less. Similarly, although the embodiments above have been described having two extendable blades or two extending pistons, the reamers described herein may employ a single such movable member, such as a single blade or a single piston, or may include a combination of extendable blades and extendable pistons.

As described above, the embodiments previously discussed provide reaming, stabilizing and centering functions, and do so in an eccentric tool having the capability of expanding to form a larger borehole beneath a previously cased borehole segment. In certain bi-center drilling and reaming applications, it is known to separate the pilot bit and the winged reamer by a substantial distance, and to employ several full-gage stabilizers in the pilot hole between the pilot bit and the reamer. In this application, the lateral load applied by the formation to the reamer is transferred to the stabilizer that is immediately below the reamer. However, in some applications, this stabilizer may not be properly oriented and sized to resist the load without cutting into the formation. When this occurs, the reamer then does not run "on center" such that the reamed hole may be smaller than desired. Further, and significantly, if the stabilizer is positioned significantly below the winged reamer, a bending moment is created that causes the drill string to tilt, causing the reamer to run off-center, again leading to an undersized borehole.

Another embodiment of the present invention may be employed in such a bottom hole assembly and disposed above the winged reamer so as to resist the tilting of the drill string and thereby insuring that the proper size borehole is created. In this embodiment, because the enlarged borehole is formed by the winged reamer spaced from the pilot bit, the eccentric reamer/stabilizer of the present invention may be configured differently than described above. More particularly, referring to FIG. 19, there is shown a eccentric reamer and stabilizer 700 having extendable blades 40, 42 configured and operable in the ways previously described with respect to FIGS. 1 through 8; however, in this embodiment, reamer/stabilizer 700 does not employ a fixed blade such as blade 30 of eccentric reamer 10 previously described. In this embodiment, the reamer/stabilizer 700 has a primary function of preventing drill string tilt between the pilot bit and an upstream reamer. Accordingly, to prevent such tilt and insure that a properly sized borehole is created, extendable blades 40, 42 are actuated to create two contact points with the borehole wall 720 for centering the drill string. Although blades 40, 42 are shown in this embodiment having cutter elements 300, eccentric stabilizer/reamer 700 need not employ such cutters given that the winged reamer below will perform that function. When employed, however, cutters 300 will provide a second reaming pass. Likewise, although the embodiment shown in FIG. 19 is described as having extendable blades 40, 42, it may instead employ extending pistons, such as pistons 570, 571 previously described with reference to FIGS. 12–14.

Figure 20:
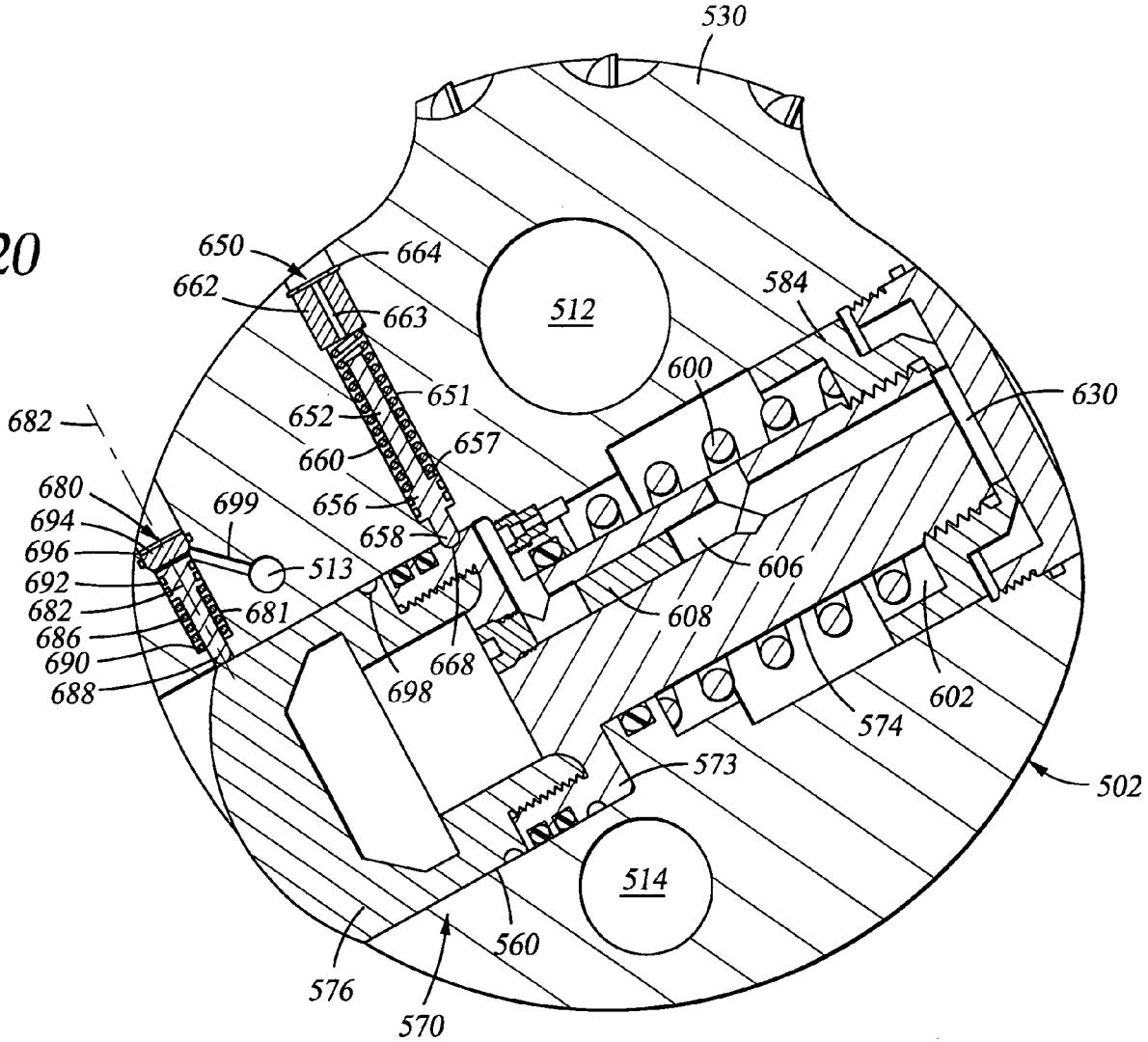
FIG. 20 is a cross-sectional view of another embodiment of an eccentric, adjustable diameter reamer showing the movable member in its contracted position.

Latching retainers in the form of shear pins have previously been described as means for retaining movable members in their retracted position until extension is required. In addition to shear pins, other latching or retaining means may be employed. Further, in certain applications, it is desirable to include a latching retainer to keep the movable member in its extended position. Accordingly, referring now to FIGS. 20, 21, disclosed is a latching retainer 650 for maintaining a movable member, such as piston 570 in its retracted position, and a latching retainer 680 for maintaining the piston 570 in an extended position. In this example, the reamer assembly includes a reamer body 502 having longitudinal through-bores 512, 513, 514 and having an extendable piston 570 disposed in piston bore 560, all as previously described. Retainer 650 includes a bore 651 and a piston 652 disposed within bore 651. Retainer 650 further includes a recess, such as an annular groove or channel 668 formed on the large diameter portion 573 of piston shaft 572. Piston 652 includes a large diameter portion 656 having shoulder 657 and a latching extension 658 extending from large diameter portion 656. A biasing spring 660 is disposed about the body of piston 652 and extends between large diameter portion 656 and an annular spacer member 662. Spacer member 662 includes a central through bore 663 and is retained in bore 651 by snap r ing 664. Bore 651 is in fluid communication with chambers 602 and 630 such that an increased fluid pressure behind piston 570 and the resulting pressure drop as compared to the annulus pressure will cause piston 652 to move in bore 651 toward spacer 662. As piston 652 moves, the rounded end of latching extension 658 is displaced from recess or groove 668 in the piston shaft such that the piston 570 can extend from body 502.

Figure 21:
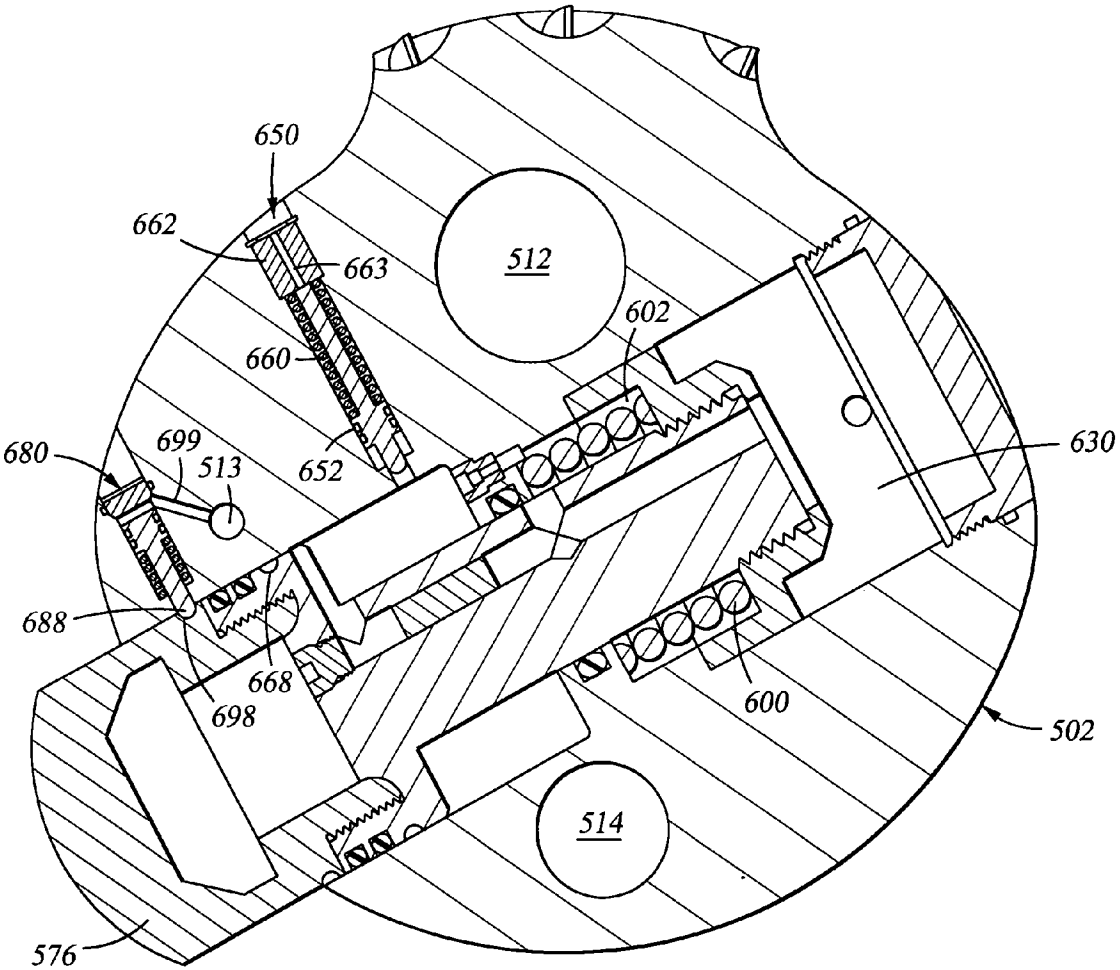
FIG. 21 is a cross-sectional view of the reamer shown in FIG. 20 with the movable member shown in its extended position.

The increased fluid pressure within reamer body 502 and the pressure differential as compared to the annulus is sufficient to maintain piston 570 in its extended position as previously described. However, it may also be desirable to include an additional retaining means to prevent unintended retraction of the piston. Accordingly, a latching retainer 680 is disclosed including bore 681, piston 682, and recess or groove 698 formed in piston head 576. Bore 681 is formed through reamer body 502 and piston 682 including shoulder 686 and latching extension 688 is disposed therein. Spring 690 is disposed about latching extension 688 and acts to bias latching extension 688 away from piston head 576. Piston 682 includes seals 692 and is retained in bore 681 by a sealed plug member 694 and snap ring 696. Plug member 694 seals bore 681 from the borehole annulus. The upper segment of bore 681 (above location of seals 692) is in fluid communication with longitudinal fluid through bore 513 via interconnecting passageway 699. Upon increased fluid pressure in chambers 630, 602 behind piston 570, the piston will begin to extend as previously described. Simultaneously, the increased pressure in bore 681 will act against piston 682 tending to force the latching extension 688 toward piston head 576. As the piston head 576 continues to extend, the rounded end of latching extension 688 extends into groove 698 to provide a means to latch piston 570 in its extended position as shown in FIG. 21. In use, should a force tending to push the piston toward its contracted position be of a predetermined magnitude, the rounded end of latching extension piston 688 will be forced against the outermost edge of groove 698, and in a camming action, extension 688 will be forced from its latching engagement with piston 570. This release mechanism is provided to prevent damage from occurring to the piston or other movable member. Otherwise, latching retainer 680 will retain piston 570 in the extended position of FIG. 21 until it is retracted in response to a reduced pressure of the drilling fluid.

Upon decreasing the pressure of the drilling fluid to a predetermined magnitude, spring 690 will act against piston 682 so as to retract latching extension 688 from groove 698. At the same time, spring 600 will bias the piston member 570 back to its retracted position shown in FIG. 20. As piston 570 reaches its retracted position, latching extension 658 of piston 652 in latching retainer 650 will engage groove 668 and thereby latch piston 570 in its retracted position.

As described above, latching retainers 650, 680 may be employed repeatedly to latch the movable member 570 in the retracted and extended positions, respectively. In this manner, these retaining means need not be replaced as is the case with a shear pin or other single-use retainers. In addition, as compared to latching retainers that operate by shearing a component, the spring biased latching retainers 650, 680 may be constructed so as to withstand a greater fluid pressure behind piston 570 before releasing the piston to move from its retracted position. This may be accomplished by varying the size of the piston, spring, or spring force, as examples. Such a feature may be desirable so as to increase the useable drilling fluid pressures, and change in pressures, as may be necessary to effectuate the operation of other downhole tools when it is not desirable to extend the movable members of the reamer or stabilizer.

Figure 22:
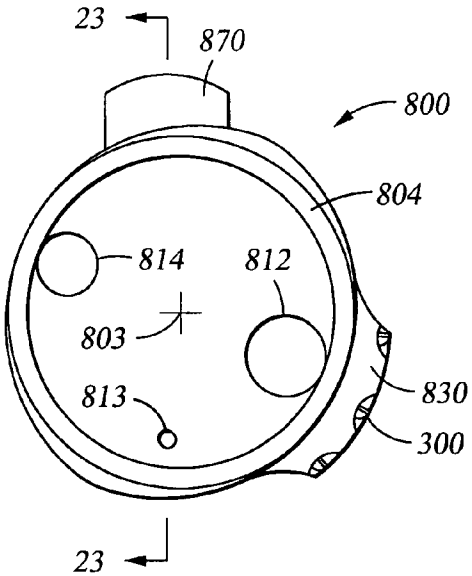
FIG. 22 is an elevation view of the top end of another adjustable diameter, eccentric stabilizer shown with an extending member in its extended position.
Figure 23:
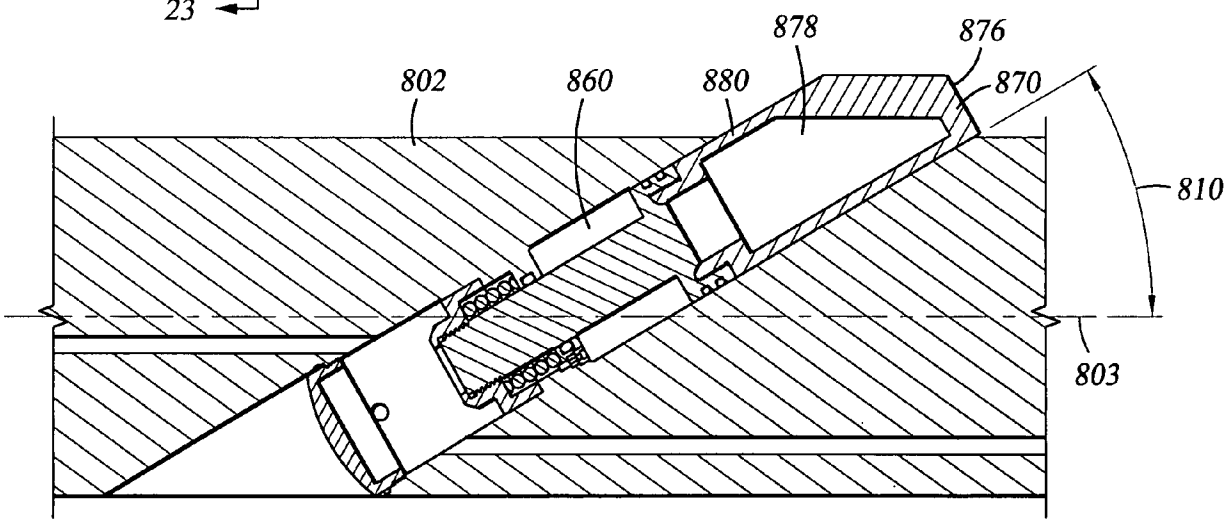
FIG. 23 is a cross-sectional view taken at plane 23—23 in FIG. 22.

The movable members used to expand the diameter of the eccentric reamers and stabilizers previously described have been depicted as extending in a direction generally perpendicular to the longitudinal axis of the tool housing. For example, referring momentarily to FIG. 12A, pistons 570 and 571 of FIGS. 13A, 14 extend generally perpendicular to axis 503. However, in order to increase the force that may be applied by such movable members against the borehole wall so as to perform the reaming and centering functions described herein, it may be desirable in certain applications to provide movable members that extend from the housing at an angle other than perpendicular to axis 503. More specifically, referring to FIGS. 22, 23, an eccentric expandable diameter reamer assembly 800 is shown to include housing 802 with upper end 804 (FIG. 22) and fluid through bores 812–814. Reamer assembly 800 further includes a fixed blade 830 including a plurality of cutter elements 300, and an extendable piston 870 in bore 860, piston 870 shown in its extended position in the figures. As best shown in FIG. 23, piston 870 extends from housing 802 at an angle 810 relative to longitudinal axis 803. Piston 870 is constructed and actuated as previously described with respect to piston 570 but is angled with respect to axis 803 so as to enable the piston to exert a greater force on the borehole wall due to the mechanical advantage arising from the piston being angled upward (toward the top of the borehole). This orientation further offers mechanical assistance in retracting piston 870 should it become stuck in the extended position in that, as the piston head engages the lowermost edge of a casing string, for example, the force applied by the casing will tend to push the piston back to its retracted position.

As previously described with respect to other embodiments, piston 870 includes a piston head 876 including a internal chamber 878 and a thin-walled segment 880, segment 880 being provided to permit the piston head 876 to shear to allow retrieval of the drilling assembly should the piston becomes stuck in the extended position and fail to retract by other means. Likewise, piston 870 may include latching retainers to retain the piston in its contracted position, or its extended position, or both. While the angle 810 may vary considerably depending upon the application, a range particularly appropriate for enhancing the applied force is between approximately 10 to 60 degrees.

While the presently preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A drilling assembly for drilling a borehole through earthen formations, comprising:

a bottom hole assembly including a pilot bit and a reamer spaced apart and uphole from said pilot bit;

an adjustable diameter stabilizer on said bottom hole assembly adjacent to said reamer, said adjustable diameter stabilizer comprising:

a housing having a rotational axis, an outer surface and a first diameter;

a pair of moveable members, each of said moveable members being free of rotational pivot points and having contact surfaces for contacting the borehole wall, said members moveable from a first position in said housing where said contact surfaces fall within the circle defined by said first diameter to a second position where said contact surfaces of said moveable members extend beyond the circle defined by said first diameter.

2. The drilling assembly of claim 1 further comprising:

actuators for forcing said movable members from said first position to said second position; and latching retainers engaging said movable members and retaining said movable members in said first position until a predetermined force is applied to said movable members by said actuators.

3. The drilling assembly of claim 2 wherein said latching retainers comprise a shear pin.

4. The drilling assembly of claim 2 wherein said latching retainers comprise spring-biased piston members.

5. The drilling assembly of claim 1 wherein said moveable members comprise at least one elongate blade reciprocally mounted in a slot formed in said housing.

6. The drilling assembly of claim 1 wherein said moveable members comprise at least one piston reciprocally mounted in a bore formed in said housing.

7. The drilling assembly of claim 2, further comprising latching retainers engaging said moveable members and retaining said moveable members in said second position.

8. The drilling assembly of claim 5, wherein said blade comprises a plurality of cutter elements mounted thereon for engaging formation material when said blade is in said second position.

9. A bottomhole assembly for drilling a borehole through earthen formations, comprising:

a pilot bit at the end of the bottomhole assembly;

a reamer spaced apart and uphole from said pilot bit;

an adjustable diameter stabilizer spaced apart and uphole from said pilot bit, said stabilizer comprising:

a housing having a rotational axis and an outer surface defining a first diameter; and at least two moveable members in said housing, each of said moveable members being free of rotational pivot points and having contact surfaces for contacting the borehole wall, said members moveable from a first position in which said contact surfaces fall within said first diameter defined by said outer surface to a second position where said contact surfaces extend beyond said diameter defined by said outer surface.

10. The bottomhole assembly of claim 9, wherein said reamer is positioned between said pilot bit and said adjustable diameter stabilizer.

11. The bottomhole assembly of claim 9, wherein at least one of said moveable members comprises an elongate blade.

12. The bottomhole assembly of claim 9, wherein at least one of said moveable members comprises a piston.

13. The bottomhole assembly of claim 12, wherein said piston reciprocates along a path forming an angle of between approximately 10° and 60° with respect to said rotational axis of said housing.

14. The bottomhole assembly of claim 11, wherein said blade includes a plurality of cutter elements for engaging formation material when said blade is in said second position.

15. The bottomhole assembly of claim 9, further comprising:

actuators for forcing said moveable members from said first position to said second position; and latching retainers engaging said moveable members and retaining said moveable members in said first position until a predetermined force is applied to said moveable members by said actuators.

16. The bottomhole assembly of claim 15, further comprising latching retainers engaging said moveable members and retaining said moveable members in said second position.

17. A bottomhole assembly for drilling a borehole through earthen formations, comprising:

a drill bit at one end of said bottomhole assembly;

a reamer spaced apart from said bit;

an adjustable diameter stabilizer spaced apart from said bit at a position adjacent to said reamer, said stabilizer comprising:

a housing;

a fluid passageway in said housing; and at least two moveable members actuatable to move from a first position where said stabilizer has a first diameter to a second position where said stabilizer has a second diameter that is greater than said first diameter;

latching retainers releaseably connecting said moveable members with said housing, said retainers holding said moveable members in said first position at fluid pressures within said fluid passageway less than a predetermined threshold pressure, and releasing said moveable members at a fluid pressure equal to or greater than said predetermined threshold pressure.

18. The bottomhole assembly of claim 17, wherein at least one of said moveable members comprises an elongate blade.

19. The bottomhole assembly of claim 18, wherein each of said moveable members comprises an elongate blade and wherein at least one of said elongate blades includes a plurality of cutter elements mounted thereon.

20. The bottomhole assembly of claim 17, wherein at least one of said moveable members comprises a reciprocating piston.

21. The bottomhole assembly of claim 20, wherein said housing includes a rotational axis and wherein said piston reciprocates along a path forming an angle with said rotational axis of between approximately 10° and 60°.

22. The bottombole assembly of claim 17, further comprising actuators in said housing extending said moveable members from said first position to said second position, and retractors in said housing retracting said moveable members from said second position to said first position.

23. The bottomhole assembly of claim 22, wherein said actuators are in fluid communication with said fluid passageway and wherein said retainers retain said moveable members in said first position at fluid pressures in said passageway that are less than a predetermined actuating pressure.

24. The bottomhole assembly of claim 22, further comprising latching retainers engaging said moveable members and releaseably latching said moveable members in said second position.

25. The bottomhole assembly of claim 24, wherein said latching retainers comprise at least one shear pin disposed in aligned bores formed in said housing and in said moveable members.

26. The bottomhole assembly of claim 24, wherein said latching retainers comprise a piston member with an extension disposed in a recess formed in said moveable members.

27. The bottomhole assembly of claim 26, wherein said piston extension is spring-biased into said recess.

28. The bottombole assembly of claim 24, wherein said reamer is disposed between said stabilizer and said bit.

29. The bottomhole assembly of claim 28, wherein at least one of said moveable members includes a plurality of cutter elements mounted thereon for engaging the formation material as the bottomhole assembly is rotated.

* * * * *